US010830004B2

(12) United States Patent
Haugvaldstad

(10) Patent No.: US 10,830,004 B2
(45) Date of Patent: Nov. 10, 2020

(54) STEERING PADS WITH SHAPED FRONT FACES

(71) Applicant: Schlumberger Technology Corporation, Sugar Land, TX (US)

(72) Inventor: Kjell Haugvaldstad, Trondheim (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 185 days.

(21) Appl. No.: 15/574,454

(22) PCT Filed: May 19, 2016

(86) PCT No.: PCT/US2016/033175
§ 371 (c)(1),
(2) Date: Nov. 15, 2017

(87) PCT Pub. No.: WO2016/187372
PCT Pub. Date: Nov. 24, 2016

(65) Prior Publication Data

US 2018/0128060 A1 May 10, 2018

Related U.S. Application Data

(60) Provisional application No. 62/320,059, filed on Apr. 8, 2016, provisional application No. 62/164,502, filed on May 20, 2015.

(51) Int. Cl.
*E21B 17/10* (2006.01)
*E21B 7/06* (2006.01)

(52) U.S. Cl.
CPC ..... *E21B 17/1014* (2013.01); *E21B 7/06* (2013.01)

(58) Field of Classification Search
CPC ..... E21B 17/1014; E21B 7/06
See application file for complete search history.

(56) References Cited

U.S. PATENT DOCUMENTS

| | | | |
|---|---|---|---|
| 5,113,953 | A | 5/1992 | Noble |
| 5,265,682 | A | 11/1993 | Russell et al. |
| 5,520,255 | A | 5/1996 | Barr et al. |
| 5,553,678 | A | 9/1996 | Barr et al. |
| 5,553,679 | A | 9/1996 | Thorp |
| 5,582,259 | A | 12/1996 | Barr |
| 5,603,385 | A | 2/1997 | Colebrook |
| 5,673,763 | A | 10/1997 | Thorp |
| 5,685,379 | A | 11/1997 | Barr et al. |

(Continued)

OTHER PUBLICATIONS

International Preliminary Report on Patentability issued in International Patent Application PCT/US2016/033175, dated Nov. 30, 2017. 12 pages.

(Continued)

*Primary Examiner* — Michael R Wills, III

(57) ABSTRACT

A rotary steerable device includes a steering pad disposed with a drilling tool and radially moveable relative to a centerline of the drilling tool to apply a steering force to a borehole wall. The steering pad has a front face to contact the borehole wall and having a diameter or width and a tapered section that tapers inward at a taper angle toward the centerline along a taper length in the direction from a take-off position to a leading edge relative to one of a rotational direction of the drilling tool or a drilling direction.

20 Claims, 19 Drawing Sheets

(56) References Cited

U.S. PATENT DOCUMENTS

| | | | | |
|---|---|---|---|---|
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |
| 5,971,085 | A | 10/1999 | Colebrook | |
| 6,089,332 | A | 7/2000 | Barr et al. | |
| 6,092,610 | A | 7/2000 | Kosmala et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 8,708,064 | B2 | 4/2014 | Downton et al. | |
| 9,022,141 | B2 | 5/2015 | Panchal et al. | |
| 2001/0052428 | A1 | 12/2001 | Larronde et al. | |
| 2002/0011359 | A1 | 1/2002 | Webb et al. | |
| 2005/0241858 | A1* | 11/2005 | Eppink | E21B 10/325 175/325.1 |
| 2006/0185902 | A1 | 8/2006 | Song et al. | |
| 2007/0119629 | A1 | 5/2007 | Hughes et al. | |
| 2008/0053707 | A1 | 3/2008 | Martinez et al. | |
| 2011/0005836 | A1 | 1/2011 | Radford et al. | |
| 2012/0160565 | A1 | 6/2012 | Downton et al. | |
| 2015/0107902 | A1* | 4/2015 | Downton | E21B 7/062 175/45 |

OTHER PUBLICATIONS

International Search Report and Written Opinion issued in International Patent application PCT/US2016/033175, dated Aug. 16, 2016. 15 pages.

* cited by examiner

STEERING PADS WITH SHAPED FRONT FACES

CROSS-REFERENCE TO RELATED APPLICATIONS

The present application claims priority to and the benefit of U.S. Provisional Patent Application No. 62/164,502 entitled "STEERING ACTUATORS WITH SHAPED FRONT FACES" filed on May 20, 2015 and U.S. Provisional Patent Application No. 62/320,059 entitled "STEERING PADS WITH SHAPED FRONT FACES" filed on Apr. 8, 2016 the entire disclosures of which are incorporated herein by reference.

BACKGROUND

This section provides background information to facilitate a better understanding of the various aspects of the disclosure. It should be understood that the statements in this section of this document are to be read in this light, and not as admissions of prior art.

In underground drilling, a drill bit is used to drill a borehole into subterranean formations. The drill bit is attached to sections of pipe that stretch back to the surface. The attached sections of pipe are called the drill string. The section of the drill string that is located near the bottom of the borehole is called the bottom hole assembly (BHA). The BHA typically includes the drill bit, sensors, batteries, telemetry devices, and other equipment located near the drill bit. A drilling fluid, called mud, is pumped from the surface to the drill bit through the pipe that forms the drill string. The primary functions of the mud are to cool the drill bit and carry drill cuttings away from the bottom of the borehole and up through the annulus between the drill pipe and the borehole.

Because of the high cost of setting up drilling rigs and equipment, it is desirable to be able to explore formations other than those located directly below the drilling rig, without having to move the rig or set up another rig. In off-shore drilling applications, the expense of drilling platforms makes directional drilling even more desirable. Directional drilling refers to the intentional deviation of a wellbore from a vertical path. A driller can drill to an underground target by pointing the drill bit in a desired drilling direction

SUMMARY

According to one or more aspects of the disclosure, a rotary steerable device includes a steering pad disposed with a drilling tool and radially moveable relative to a centerline of the drilling tool to apply a steering force to a borehole wall. The steering pad has a front face to contact the borehole wall and having a diameter or width and a tapered section that tapers inward at a taper angle toward the centerline along a taper length in the direction from a take-off position to a leading edge relative to one of a rotational direction of the drilling tool or a drilling direction.

According to one or more aspects of the disclosure, a bottom hole assembly (BHA) includes a drill bit having a gauge and a centerline extending in a drilling direction, a tool connected with the drill bit and having an upper steering pad and a lower steering pad axially aligned in the drilling direction, the steering pads radially moveable along a travel length from a fully retracted position to a fully extended position and each of the steering pads having a front face with an axial leading edge in the drilling direction and a rotational leading edge relative to a direction of rotation of the drilling tool and the front face has an axial tapered section that tapers inward at a taper angle toward the centerline along a taper length in the direction from a first take-off position to the axial leading edge.

A method according to one or more aspects of the disclosure includes preparing a steering pad for a drilling tool having a center line oriented along a drilling direction, the steering pad having an actuation axis oriented perpendicular to the centerline, and a front face having an axial leading edge in the drilling direction and a rotational leading edge relative to a direction of rotation of the drilling tool, and the front face having an axial tapered section that tapers inward at a taper angle toward the centerline along a taper length in the direction from a first take-off position to the axial leading edge.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure can be understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
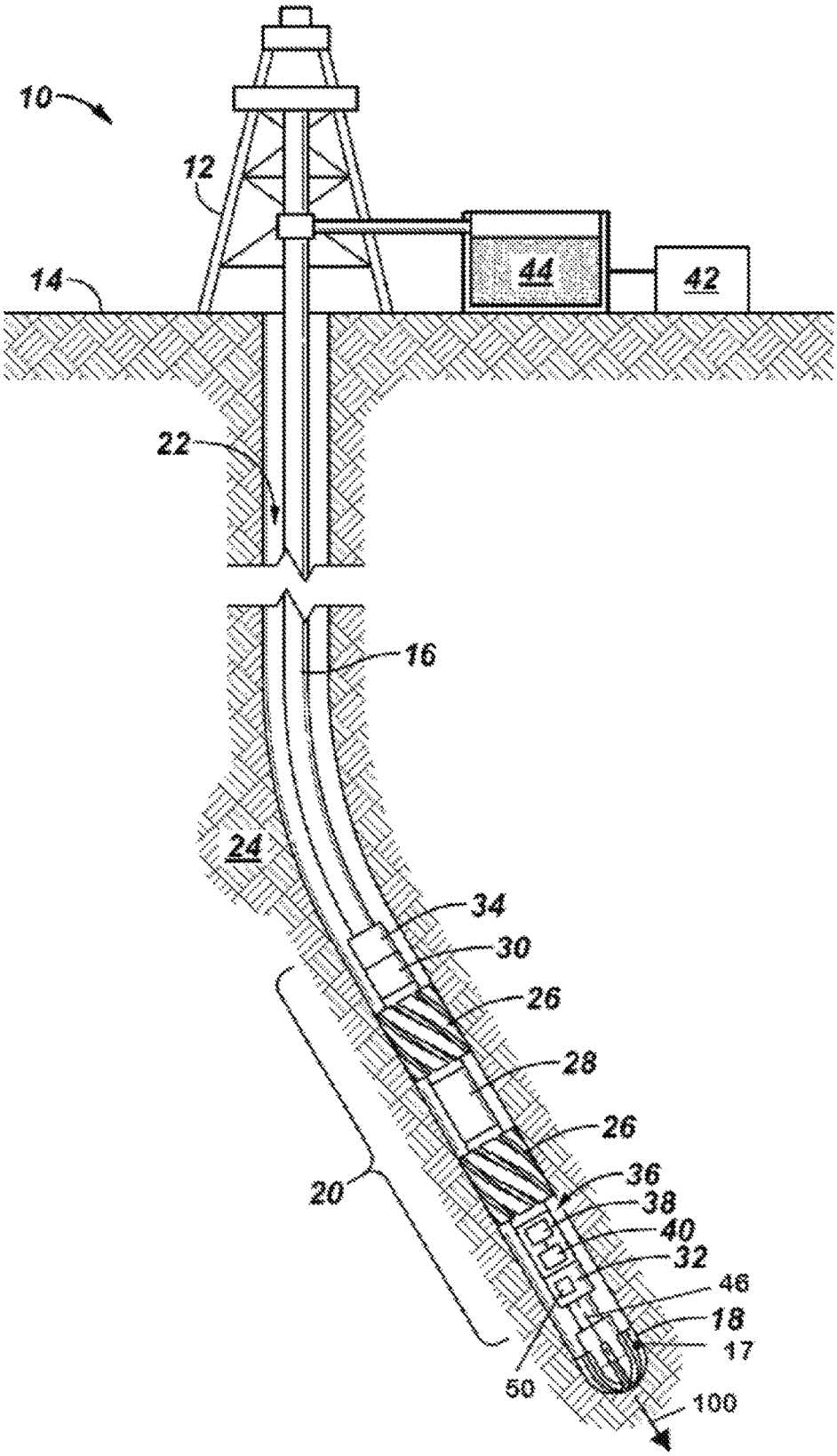
FIG. 1 illustrates a directional drilling system in which shaped face steering pads in accordance to aspects of the disclosure can be utilized.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements. Commonly, these terms relate to a reference point such as the surface from which drilling operations are initiated.

The directional drilling process creates geometric boreholes by steering a drilling tool along a planned path. A directional drilling system utilizes a steering assembly to steer the drill bit and to create the borehole along the desired path (i.e., trajectory). Steering assemblies may be classified generally, for example, as a push-the-bit or point-the-bit devices. Push-the-bit devices apply a side force on the formation to influence the change in orientation. A point-the-bit device is when the bottom hole assembly has a fixed bend in the geometry. Rotary steerable systems (RSS) provide the ability to change the direction of the propagation of the drill string and borehole while drilling.

According to embodiments, control systems may be incorporated into the downhole system to stabilize the orientation of propagation of the borehole and to interface directly with the downhole sensors and actuators. For example, directional drilling devices (e.g., RSS and non-RSS devices) may be incorporated into the bottom hole assembly. Directional drilling may be positioned directly behind the drill bit in the drill string. According to one or more embodiments, directional drilling devices may include a control unit and bias unit. The control unit may include, for example, sensors in the form of accelerometers and magnetometers to determine the orientation of the tool and the propagating borehole, and processing and memory devices. The accelerometers and magnetometers may be referred to generally as measurement-while-drilling sensors. The bias unit may be referred to as the main actuation portion of the directional drilling tool and the bias unit may be categorized as a push-the-bit or point-the-bit. The drilling tool may include a power generation device, for example, a turbine to convert the downhole flow of drilling fluid into electrical power.

Push-the-bit steering devices apply a side force to the formation and this provides a lateral bias on the drill bit through bending in the borehole. Push-the-bit steering devices may include steering pads. In some systems a motor in the control unit rotates a rotary valve that directs a portion of the flow of drilling fluid into piston chambers. The differential pressure between the pressurized piston chambers and the formation applies a force across the surface area of the pad to the formation. A rotary valve, for example, may direct the fluid flow into a piston chamber to operate the steering pad and create the desired side force.

FIG. 1 is a schematic illustration of an embodiment of a directional drilling system, generally denoted by the numeral 10, in which embodiments of steering devices and steering pads may be incorporated. Directional drilling system 10 includes a rig 12 located a surface 14 and a drill string 16 suspended from rig 12. A drill bit 18 disposed with a bottom hole assembly (BHA) 20 and deployed on drill string 16 to drill (i.e., propagate) borehole 22 into formation 24 for example in the axial direction 100, e.g. along the longitudinal axis 46 of the drill bit 18. The drill bit 18 includes cutting elements including a gauge cutter 17.

The depicted BHA 20 includes one or more stabilizers 26, a measurement-while-drilling (MWD) module or sub 28, a logging-while-drilling (LWD) module or sub 30, and a steering tool 32 (e.g., RSS device, steering pads), and a power generation module or sub 34. Directional drilling system 10 includes an attitude hold controller 36 disposed with BHA 20 and operationally connected with steering device 32 to maintain drill bit 18 and BHA 20 on desired drill attitude to propagate borehole 22 along the desired path (i.e., target attitude). Depicted attitude hold controller 36 includes a downhole processor 38 and direction and inclination (D&I) sensors 40, for example, accelerometers and magnetometers. According to an embodiment, downhole attitude hold controller 36 is a closed-loop system that interfaces directly with BHA 20 sensors, i.e., D&I sensors 40, MWD sub 28 sensors, and steering device 32 to control the drill attitude. Attitude hold controller 36 may be, for example, a unit configured as a roll stabilized or a strap down control unit. Although embodiments are described primarily with reference to rotary steerable systems, it is recognized that embodiments may be utilized with non-RSS directional drilling tools. Directional drilling system 10 includes drilling fluid or mud 44 that can be circulated from surface 14 through the axial bore of drill string 16 and returned to surface 14 through the annulus between drill string 16 and formation 14.

The tool's attitude (e.g., drill attitude) is generally identified as the axis of BHA 20 which is identified by the numeral 46. Attitude commands may be inputted (i.e., transmitted) from a directional driller or trajectory controller generally identified as the surface controller 42 (e.g., processor) in the illustrated embodiment. Signals, such as the demand attitude commands, may be transmitted for example via mud pulse telemetry, wired pipe, acoustic telemetry, and wireless transmissions. Accordingly, upon directional inputs from surface controller 42, downhole attitude hold controller 36 controls the propagation of borehole 22 through a downhole closed loop, for example by operating steering device 32. In particular, steering device 32 is actuated to extend the steering pads 50 into contact with the wellbore wall to drive the drill to a set point.

Figure 2A:
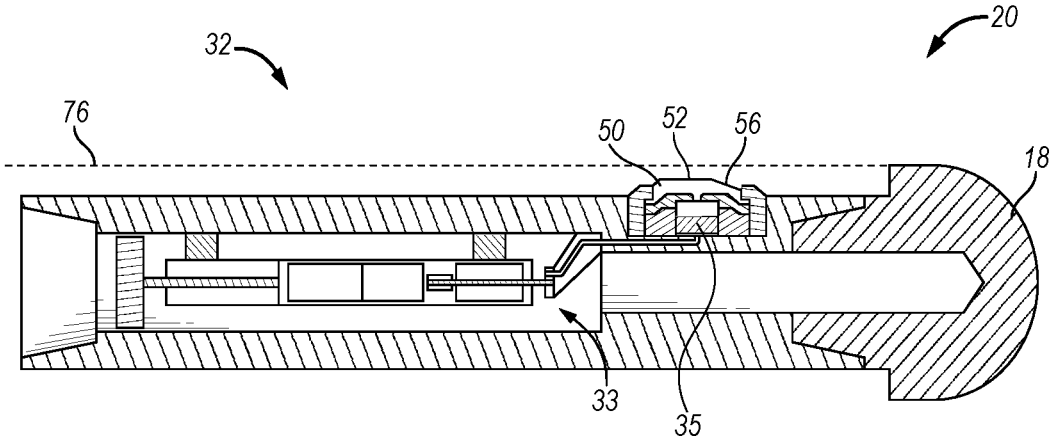
FIG. 2A is a sectional side view of a bottom hole assembly incorporating shaped face steering pads in accordance with aspects of the disclosure.
Figure 2B:
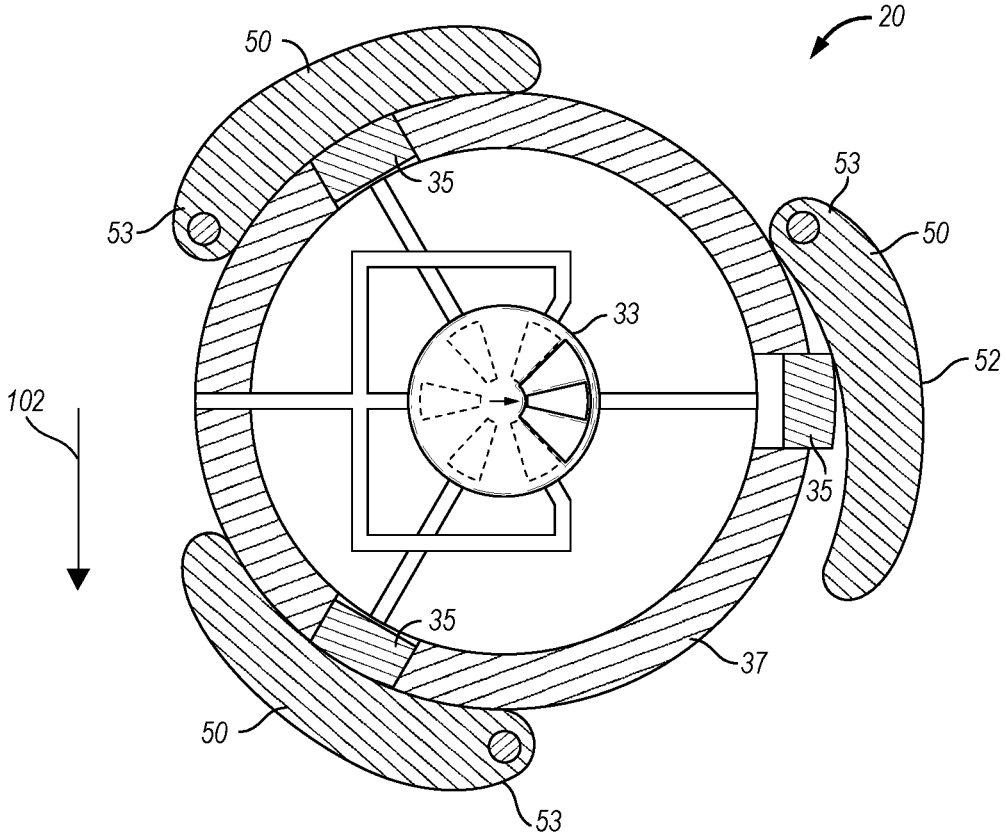
FIG. 2B is a sectional view through the steering pads of the drilling tool of FIG. 2A.

FIGS. 2A and 2B illustrate a sectional view of a bottom hole assembly (BHA) 20 in which shaped face steering pads 50 may be incorporated. BHA 20 includes a drill bit 18 having a gauge 76 illustrated by the dashed line and a steering tool 32 having radially extendable steering pads 50. In FIG. 2A the steering pad 50 is in a fully retracted to an undergauge position. An example of operation of a steering tool such as illustrated in FIGS. 2A and 2B is disclosed in U.S. Pat. No. 8,708,064, which is incorporated by reference herein. In operation drilling fluid can be selectively routed via valve 33 to radially move an actuator, e.g. piston, 35 to extend the steering pad 50 radially beyond the gauge of the drill bit to contact the wellbore wall and apply a steering force. For example, the pads 50 may be hingedly connected to a body 37 of the steering tool. The steering pads 50 have an outer or front face 52 oriented toward the wellbore wall. The front faces may be generally cylindrically shaped as illustrated in FIG. 2B relative to the gauge of the drill bit and the radius of the wellbore wall. The face 52 may be tapered at least along a portion of the face 52. For example, in FIG. 2A the face 52 has a tapered section 56 extending along an axially leading portion of pad in the drilling direction. The cross-sectional view in FIG. 2B removes the tapered section 56 shown in FIG. 2A. With reference to FIG. 2B, a leading edge 53 is indicated relative to the rotational direction 102 of the pads 50. As further described below, the rotational leading portion of the pad may be tapered to increase the rock removal contact area relative to a cylindrical shape corresponding to the wellbore or gauge radius.

Figure 2C:
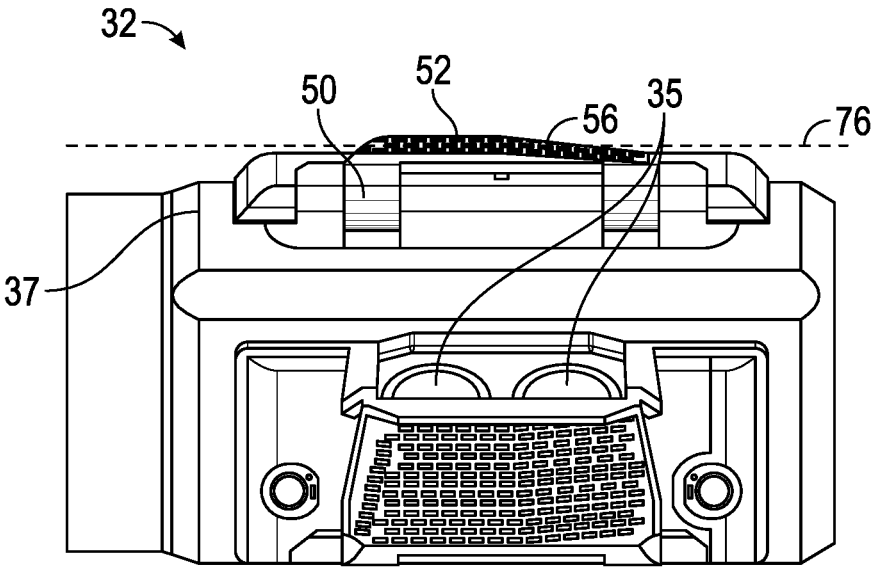
FIG. 2C is a side view of a bottom hole assembly incorporating shaped face steering pads in accordance with aspects of the disclosure.
Figure 2D:
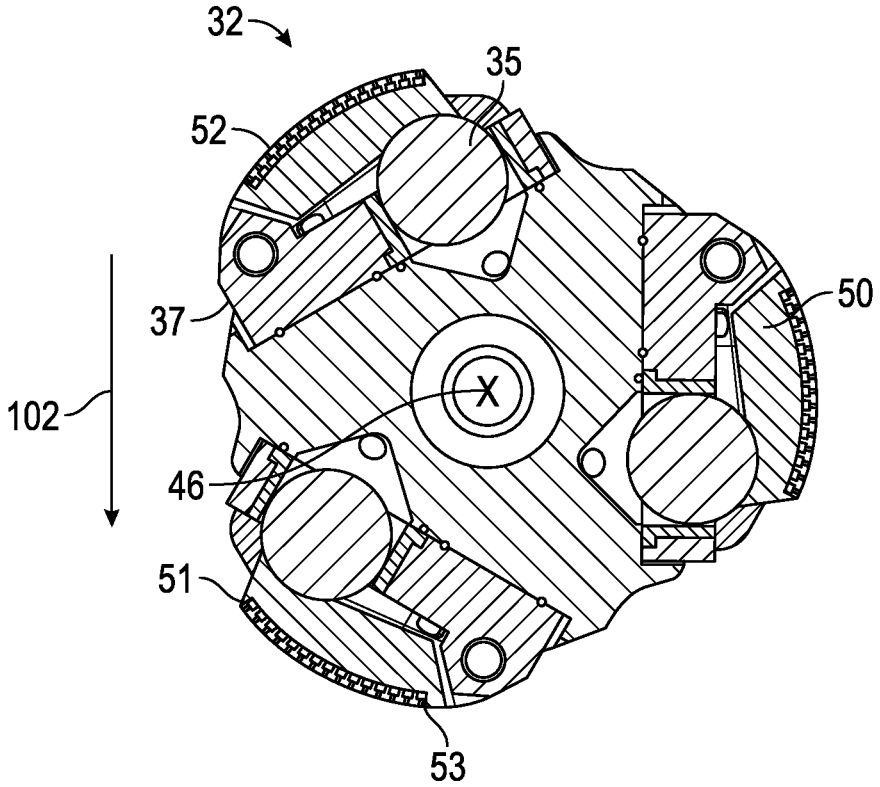
FIG. 2D is a sectional view through the steering pads of the drilling tool of FIG. 2C.

FIGS. 2C and 2D illustrate another example of a BHA 20 incorporating shaped face steering pads 50 in accordance to aspects of the disclosure. In FIGS. 2C and 2D each of the pads are shown in an open or extended position for the purpose of illustration. In this example each steering pad 50 is actuated by a pair of pistons 35 and each steering pad is hingedly connected to the body 37 to be radially moved relative to the tool between the closed or retracted position to the extended positions. In FIG. 2C the steering pad face 52 has a tapered section 56 extending along the axial leading portion of the pad in the drilling direction. The top steering pad 50 is shown partially extended relative to the gauge 76 of the drill bit 18. FIG. 2D shows the pistons 35, in the form of balls, actuated radially away from the centerline 46 of the tool biasing the steering pads radially to an extended position. The axial tapered section illustrated in FIG. 2C is removed in the section view. The rotational leading edge 53 relative to the rotational direction 102 and a circumferential tail edge 51 are shown in FIG. 2D.

Figure 3:
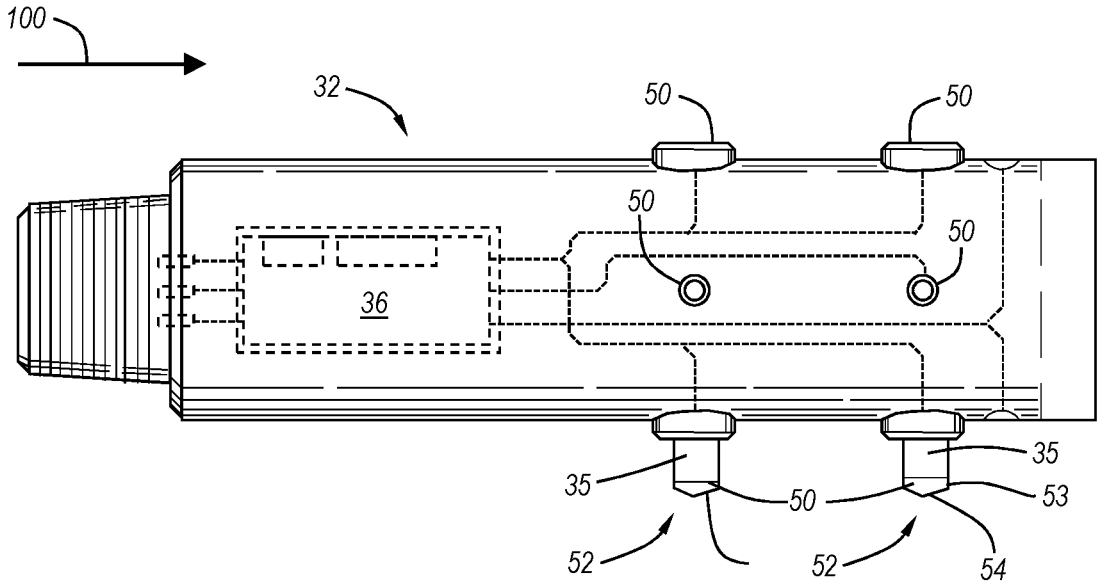
FIG. 3 illustrates a steering device incorporating radially extendable steering pads in accordance to one or more embodiments.

FIG. 3 illustrates a steering device 32 including radially extendable steering pads 50. In this example, the pad 50 is the end portion of a piston 35 that is radially moveable relative to the longitudinal axis of the tool. The steering device 32 illustrated in FIG. 3 depicts the steering pads 50 grouped in series, for example series of two, of axially aligned steering pads 50. The series of pads 50 on the bottom of the figure are illustrated radially extended relative to the longitudinal axis 46 of the tool. In the illustrated example, the steering pads of a series are located in close proximity to one another and may be operated concurrently to apply a total steering force to the borehole wall. In some embodiments the steering pads 50 are not provided in or at least not operated in series and/or groups of steering pads.

The steering pads have a shaped front face 52 to engage the wellbore wall that is wholly or partially tapered or tilted inward (away from the wellbore wall) moving in the direction toward the leading edge. In accordance to aspects at least a leading section or portion, generally denoted by the numeral 54, of the front face 52 is tapered. The leading portion 54, circumferentially (relative to the direction of rotation) and axially (relative to the drilling direction), forms the rock cutting surface of the front face. For example, in FIG. 3 the leading portion 54 extends from the leading edge 53 relative to the drilling direction 100.

Figure 4:
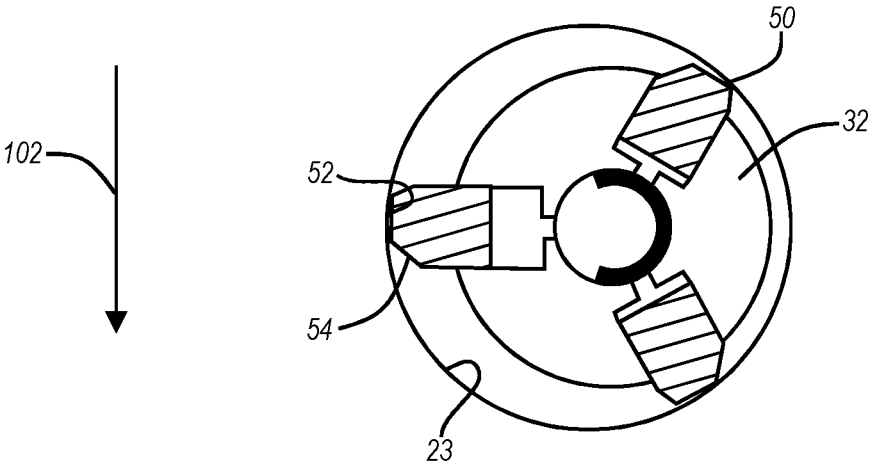
FIG. 4 illustrates a steering device disposed in a wellbore with one steering actuator extended into contact with the wellbore wall to turn the steering device and drill string.

FIG. 4 illustrates a steering device 32, such as illustrated in FIG. 3, disposed in a wellbore 22 with the drill bit removed. A steering pad 50 on the left side is illustrated radially extended with the front face 52 in contact with the borehole wall 23 to turn the wellbore 22 in the direction of the arrow. The direction of drilling is in the direction out of the paper and the tool is rotating to the right relative to the drilling direction as indicated by arrow 102. The leading portion 54 indicated in FIG. 4 is the rotational leading portion of the pad front face and it is tapered in accordance to aspects of this disclosure.

RSS push-type steering pads will, if the actuation force is high enough, tend to enlarge the hole as drilled by the preceding drill bit. As a steering pad will have a limited stroke the hole-enlargement may result in a drop in steering performance (dogleg severity) if the hole is enlarged up to a point where the pad stroke saturates. This is a risk particularly in softer rocks. The shape of the front face 52 of the steering pad will have an effect (e.g., a significant effect) on the severity of the hole-enlargement. Embodiments of shapes that will limit and/or reduce the hole-enlargement/reaming effect are disclosed herein.

For a push-type RSS is may be desirable to have a small pad that provides a large steering force. If the pad becomes too small relative to the force generated it will tend to act as a cutting element, removing the rock that it is supposed to push off from. This will result in a partial loss of effective steering force as part of the available force would be reacted against a mechanical stop feature (kicker, locking pin etc.) rather than the rock surface.

In some embodiments, to reduce the tendency of the steering pad to act as a cutting element the geometry of the leading edges, axially as well as rotationally or circumferentially, may be modified. If the shape of the leading edges of the pad results in a rock removal surface area that generates a contact pressure against the rock that is higher than the compressive strength of the rock, the pad will cut (underream) the hole. The pads rock removal contact surface is the part of the pads surface area that is in contact with rock that will, continuously, have to be cut for the pad to remain in the same radial position as the BHA drills ahead. If the leading edges of the pad are shaped to increase (e.g., significantly increase) the rock removal contact surface as a function of the pad's radial position, the pad's radial position could be kept below the maximum radial travel (where the pad saturates) and allow the steering force to be reacted against the wall of the hole for a wider range of rock strengths.

Figure 5:
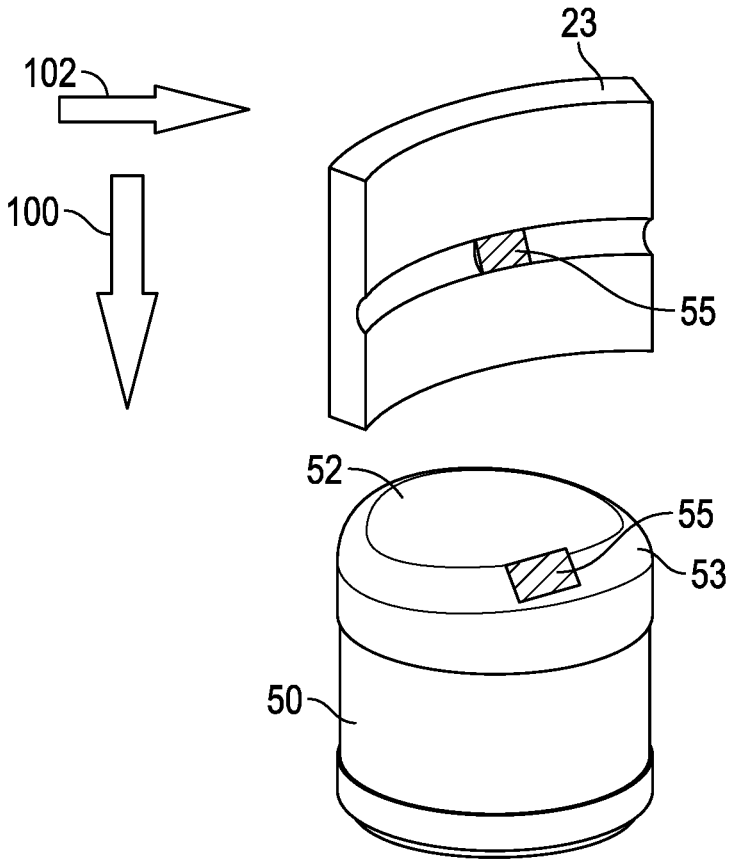
FIG. 5 illustrates a cylindrical front face of a steering pad without tapering and the associated rock removal surface area.

A wholly or partially tapered front face 52 will enlarge (e.g., significantly enlarge) the rock-removal contact surface of the pad compared to a pad with a primarily cylindrical shaped front face. An example of a non-tapered cylindrical shape is shown in FIG. 5. Front face 52 is a cylindrical front face defined by a pad radius that is close to the radius of the wellbore. The rock removal contact surface 55 is illustrated on the leading edge 53 and on the borehole wall 23. As can be seen from the illustration, the main front face area will not act to push the pad back in, only a small contact surface 55 of the edge radius 53. Once the pad has reached its maximum radial travel it is likely to reach full travel in each following actuation due to the small rock removal contact surface 55. The size of the main contact area of the front face 52, plays a part in how long, i.e. the number of BHA revolutions, it takes for the borehole to be opened up to a size where the pad saturates, but once this travel has been reached, the pad force required to move the pad to the saturation point is small compared to the available steering force. As a result, a fraction (e.g., a significant fraction) of the steering force would be reacted against a mechanical stop in the tool.

Figure 6A:
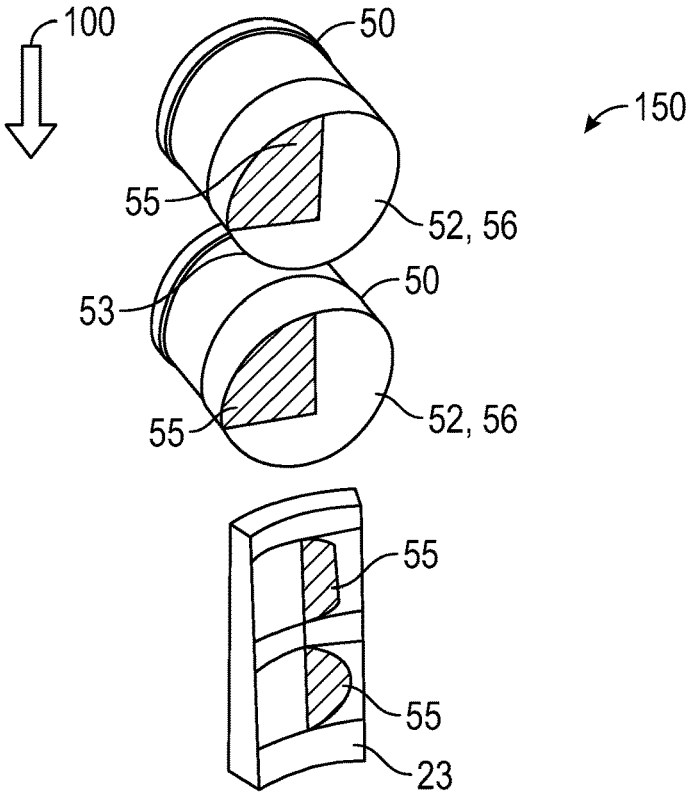
FIGS. 6A-6D illustrate examples of tapered front face steering pads and the rock removal surface in accordance to one or more aspects of the disclosure.
Figure 6B:
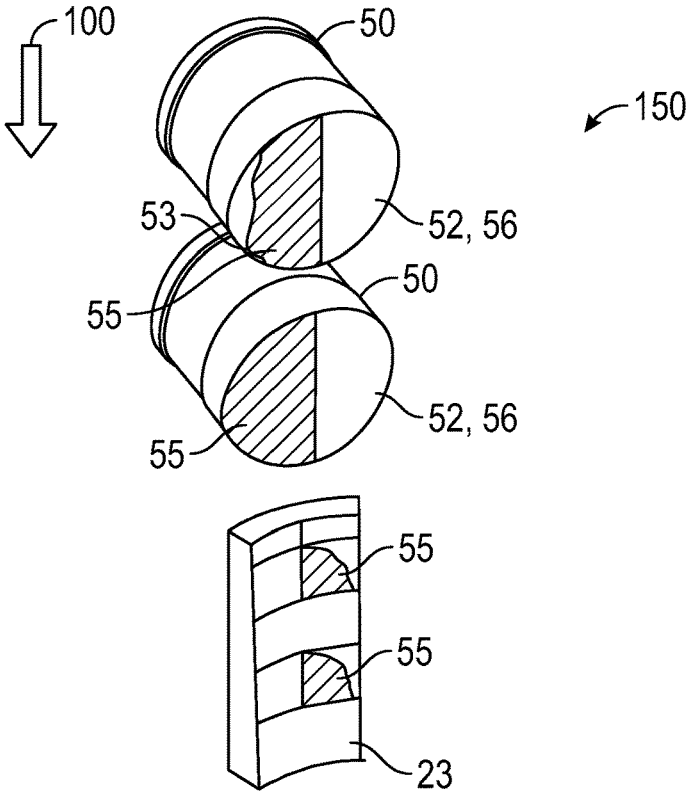
Figure 6C:
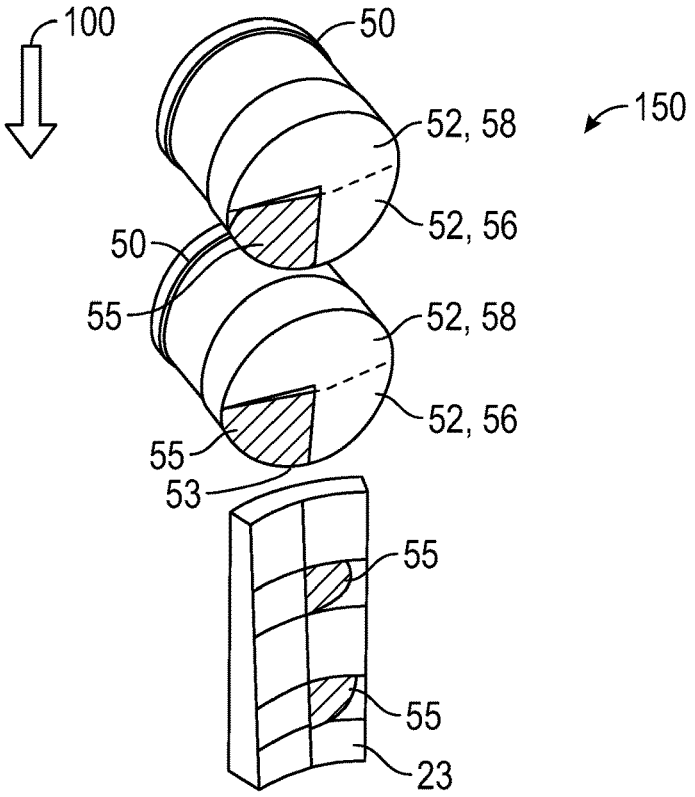
Figure 6D:
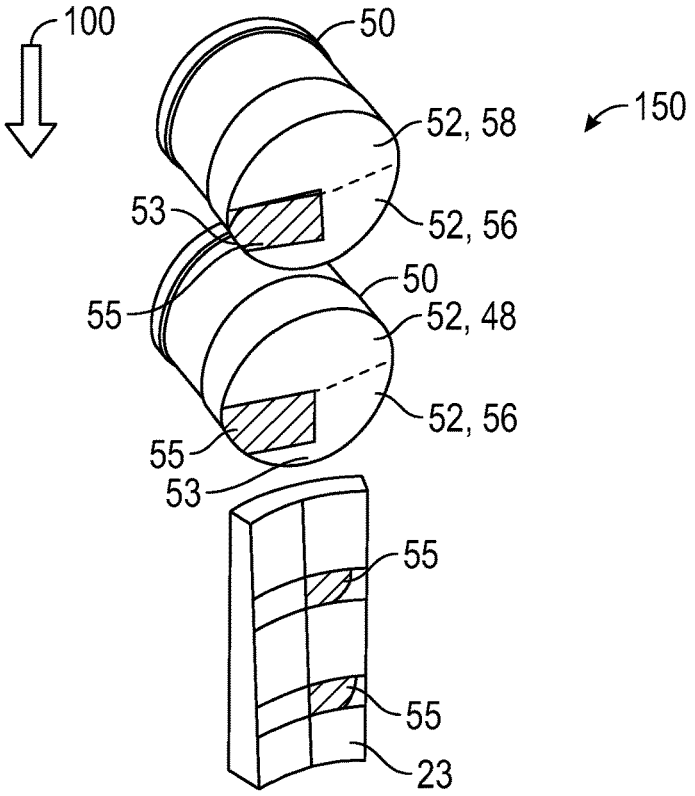

In contrast to FIG. 5, FIGS. 6A-6D illustrate shaped face pads 50 with wholly or partially tapered front faces 52. The illustrations show one set 150 of axially arranged pads 50 of a tool having a six-pad configuration where three sets 150 of two aligned pads 50 are rotationally spaced 120° apart. In FIGS. 6A and 6C the top pad 50 is at 3.0 mm of travel and the lower pad is at 1.5 mm of travel. In FIGS. 6B and 6D the top pad 50 is at 6.0 mm of travel and the lower pad is at 3.0 mm of travel. In FIGS. 6A-6D the bottom portion is the axial leading portion and the left side is the rotational leading portion.

In FIGS. 6A and 6B the whole front face 52 is a tapered section 56 having a taper angle of three degrees in the illustrated example. In FIGS. 6C and 6D the front face 52 has a tapered section 56 with a six degree taper angle and a non-tapered cylindrical shaped section 58. In the examples of FIGS. 6C, 6D the tapered section extends about one-half of the length of the front face 52 from the axial leading edge 53 located at the bottom of the pad front face 52 relative to the direction of drilling 100 to a take-off position illustrated by the broken line. The tapered section 56 also extends across about a quarter of the leading portion in the rotational direction on the bottom left side of the figures. The taper angle is relative to the tool axis as further described below. The taper angles of three degrees and six degrees as well as the size of the tapered section 56 shown in FIGS. 6A-6D are non-limiting examples. In accordance to non-limiting aspects each of the taper angles may independently range for example between limits of about >0°, 1°, 3°, 6°, 10°, 15°, 20°, 30°, and 45°, where any limit can be used in combination with any other limit. For example, in some embodiments, the taper angles may range between 1° and 30°. In some embodiments, the downhole or axial taper may be 6°. However, any suitable taper angle may be used. In addition, each pad may have a different taper within the above described ranges. In some embodiments, a single pad may have multiple tapers, e.g., a portion of a taper at 3° and another portion at 6°.

In FIGS. 5 and 6A-6D the pad is illustrated as being circular along the actuation axis which is orthogonal with the tool axis. However, the geometry of the pad is not limited to being round as illustrated for example with reference to a hinged steering pad in FIGS. 2A and 2B. The cylindrical front face is relative to circumferential length or diameter of the pad's face and the cylindrical curvature of the wellbore and is not limited to circular piston type pads or hinged type pads.

The shaded areas in FIGS. 6A-6D show the rock removal contact surface 55 which is larger than the surface contact areas illustrated on the non-tapered cylindrical front face pad in FIG. 5. The larger removal contact surface 55 distributes the load over a larger area and reduces the contact pressure against the wellbore wall 23. As such, the steering pad force reacts against the wellbore wall as opposed to a mechanical stop of the steering pad. The smaller removal contact surface 55 in FIG. 5 may be analogized to a sharp, efficient cutter of a lathe and as the tool rotates the removal contact surface of the front face efficiently cuts away at the wellbore wall and the steering pad continues to radially extend to saturation resulting in a reduction or loss of steering efficiency and also to underreaming the wellbore, i.e. hole overgauge. In accordance to embodiments, the front face 52 includes a tapered section 56 such that the contact pressure is less than the compression strength of the earthen formation of the wellbore wall.

Figure 7A:
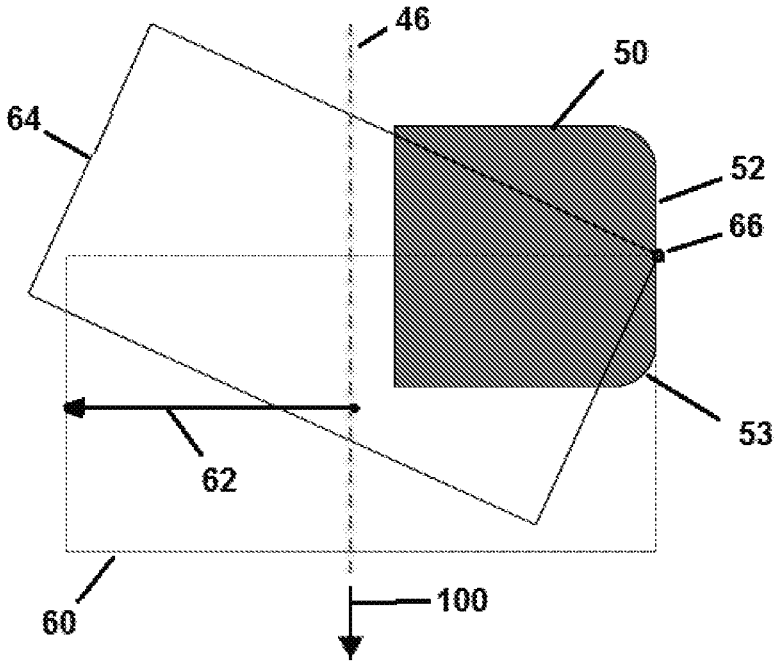
FIGS. 7A and 7B illustrate constructing a tapered front surface of a steering pad in accordance to aspects of the disclosure.
Figure 7B:
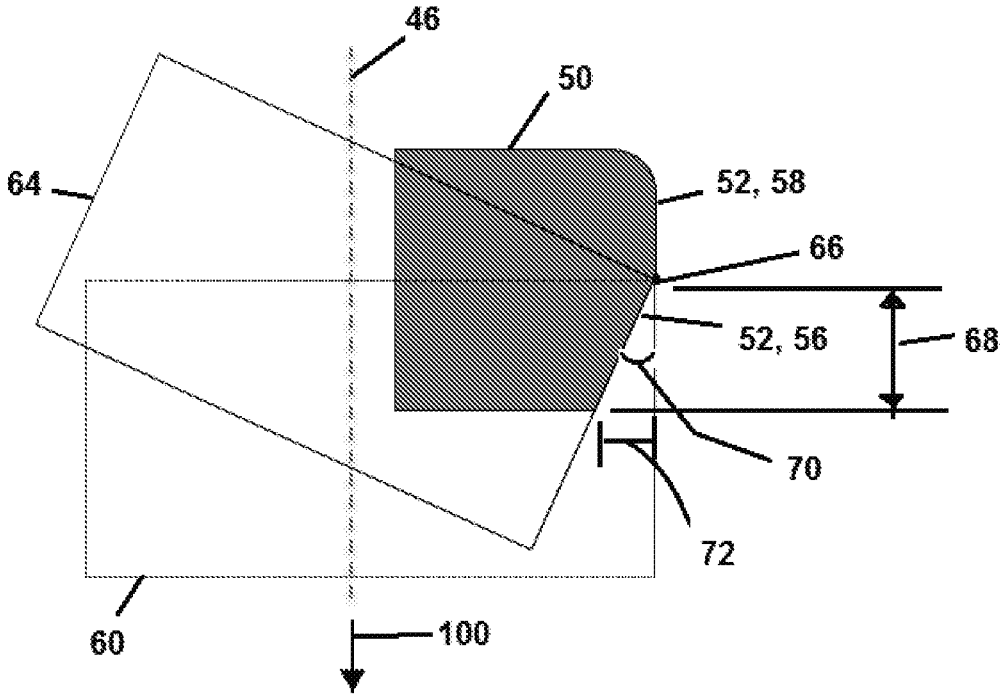

A tapered front face section 56 can be constructed for example as described with reference to FIGS. 7A and 7B. In FIG. 7A the steering pad 50 has a front face 52 that is cylindrically shaped in the rotational direction, e.g., shaped with a cylindrical radius similar to the radius of the wellbore as cut by the drill bit (i.e., the gauge of the drill bit). In FIG. 7B the front face 52 of the pad 50 has been formed, e.g., cut, to have a tapered section 56 and a non-tapered section which is a cylindrical shaped section 58 in this example. Tapered section 56 is tapered in the axial direction relative to the direction of drilling. The tapered section 56 may be a flat planar section or it may have a curve.

Line 46 is the centerline and longitudinal axis of the drill bit 18 (see FIG. 1) and the arrow points in the drilling direction 100. Cylinder 60 is coaxial with the centerline and longitudinal axis 46 of the drill bit and may be representative of the wellbore. Cylinder 60 has a radius 62, e.g., the radius from the centerline 46 of the tool to the wellbore wall (i.e., the drill bit gauge), which can be utilized to define the front face 52 of the pad in FIG. 7A with a cylindrical front face. Cylinder 64 is a rotated copy of cylinder 60 rotated axially around a point or position 66 on the front face. In FIGS. 6C and 6D this take-off position 66 is proximate to the center point of the pad front face to form a taper along the lower, axial leading portion. The front surface 52 tapers inward, toward the centerline 46, in the direction from the take-off position 66 to the leading edge 53. In other words the take-off position 66 is closer to the wellbore wall and farther away from the centerline than is the leading edge 53 of the tapered section. The take-off position is not limited to the center point of the pad's face.

The taper length 68 extends from the leading edge 53 (FIG. 7A), the axial leading edge in this example, to the take-off point 66 and at a taper angle 70 relative to the tool axis 46 which is substantially parallel to the take-off position on the front face in the axial direction. The tapered section 56 also includes a taper height 72 shown as the axial distance from the leading edge 53 to the take-off point 66. The taper angle and/or taper length may be related to the travel length of the pad 50, see for example the different contact surface areas for the different extension lengths of the pads 50 illustrated in the examples of FIGS. 6A-6D. For example, too shallow a taper angle 70 may result in a tapered section 56 that does not engage the wellbore wall over a wide range of the pad extension lengths and may result in cutting into the wall and too great of a taper angle can result in portions of the tapered section not engaging the wall. In accordance to non-limiting aspects the taper angles may range for example between about >0°-45° as discussed above. For example, the axial taper angle may range between about 1° and 6°.

The length of the tapered section 56 may be associated with the unconfined compressive strength (UCS) of the wellbore wall material. The leading edge of the front face should be shaped to provide a rock removal surface resulting in a contact pressure against the rock that is less than the compressive strength of the rock prior to the pad reaching its maximum travel. As discussed above, a portion of the pad's face may be cylindrical shaped (section 58) and tapering the rotational leading portion may include reducing the radius of curvature on the circumferential or rotational leading portion so as to increase the rock removal surface area 55.

There are other ways of tapering the front face of the steering pads using cylinders with different radii and centerlines. The method could be used for any pad that engages the rock for steering purposes. The leading edge of the front face should be shaped to provide a rock removal surface resulting in a contact pressure against the rock that is less than the compressive strength of the rock prior to the pad reaching its maximum travel.

Figure 8:
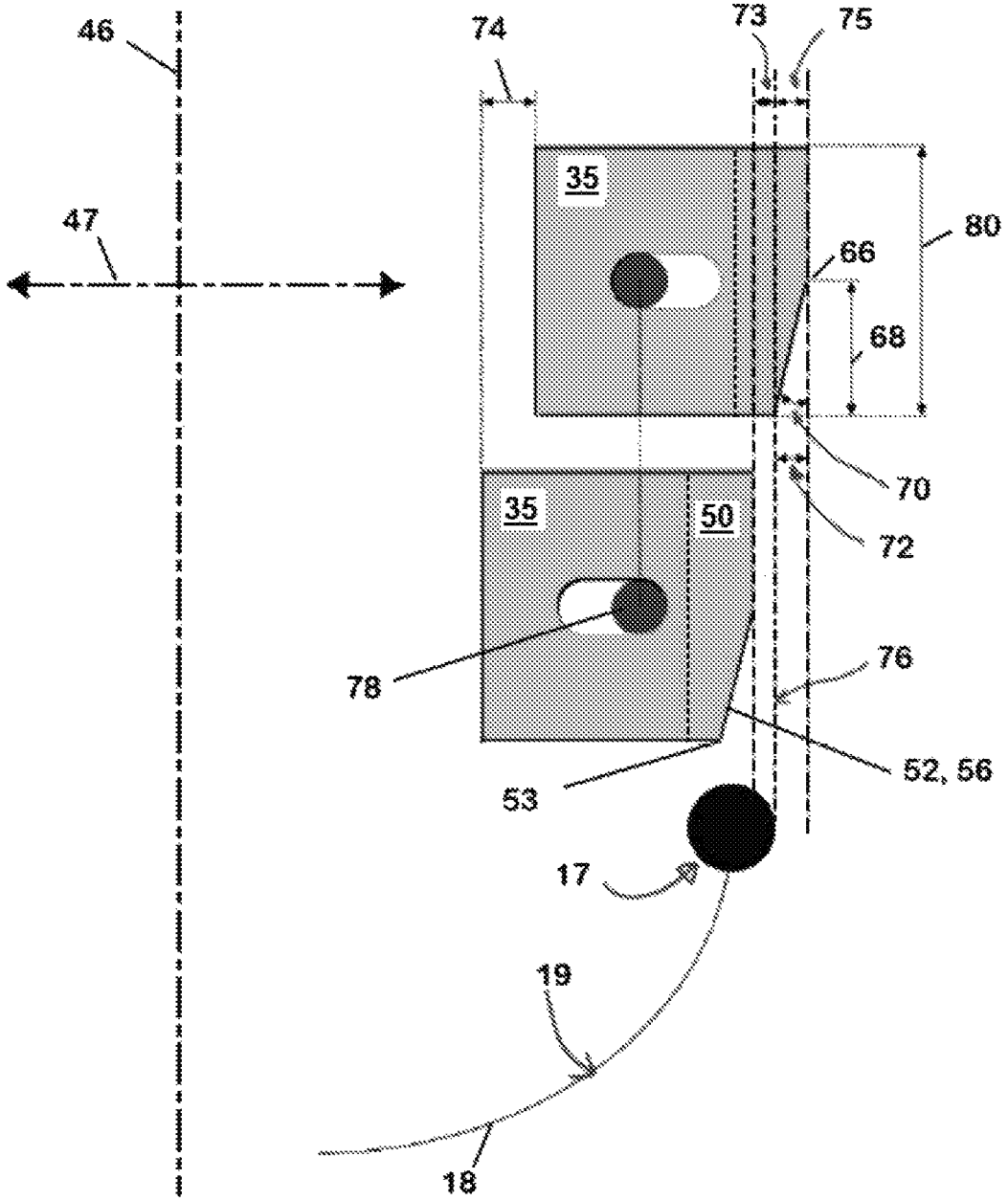
FIG. 8 illustrates a tapered front face in accordance to aspects of the disclosure relative to the travel length.

FIG. 8 illustrates axial tapered section 56 characteristics with respect to the pad travel length. FIG. 8 illustrates a steering pad 50 in a fully retracted position, the lower pad, and in a fully extended position, the upper pad. The pad 50 has a total travel identified by the reference number 74. The drill bit 18 has a blade profile 19 and a gauge 76 identified by the gauge cutter 17. The pad 50 travels radially relative the centerline 46 as shown by the actuation axis. In this example pad is actuated by an actuator or piston 35 and the length of travel of the piston is limited by a mechanical stop 78 (e.g., pin). The total travel 74 is the sum of the undergauge travel 73, which is the distance between front face 52 in the fully retracted position and the gauge 76, and the overgauge travel 75, which is the distance between the gauge 76 and the front face in the fully extended position. The pad's travel length 74 is based on the space available in the particular drilling tool, i.e., type and diameter.

The pad face 52 has a diameter or width 80, as known by those skilled in the art with benefit of this disclosure, the diameter or width dimension applies as well to a pad shape that is not round. The taper length 68 extends from a take-off position 66 inward to the leading edge 53. The taper height 72 is the axial distance along the actuation axis 47 between the leading edge 53 of the tapered section 56 and the take-off point 66 on the front face (e.g., a tangent at the take-off point to the leading edge as the point with the shortest distance to the centerline).

A taper angle $\alpha_{opt}$ may be defined by equation (1), and may maximize or increase the rock contact between the tapered surface 56 at the widest range of pad travel lengths. While this equation is described with reference to a single planar taper, it can also be used with a curved taper $$\alpha_{opt} = \alpha\tan\left(\frac{Ht}{Lt}\right) \tag{1}$$

where $H_t$ is the taper height 72 and $L_t$ is the taper length 68.

The taper length, the length of travel, and the pad face diameter or width may be selected prior to drilling and based on the rock formation characteristics and the wellbore size. Accordingly, shaped pad face dimensions may be determined and manufactured for particular reservoir formations ranges of rock strengths for example for a particular bit gauge 76. The taper angle 70 may be determined using equation (1) after the taper length 68 and the taper height 72 have been selected. In accordance to aspects of the disclosure the taper angle 70 ranges between about twenty-five percent ($0.25(\alpha_{opt})$) and four-hundred percent ($4.0(\alpha_{opt})$) of the taper angle 70 of equation 1. In some embodiments, the taper angle 70 may range between limits of about 25%, 50%, 75%, 100%, 150%, 200%, 300%, and 400% of $\alpha_{opt}$ where any limit may be used in combination with any other limit. For example, the taper angle may range from 25% to 200% of $\alpha_{opt}$.

As noted above the taper length 68 ($L_t$) may be selected based on the UCS of the formation to be drilled and the total length of travel of the pads is determined by the tool (e.g., steering tool and drill bit). In accordance to aspects of this disclosure, the taper length 68 may range between about 10 percent to 100 percent of the pad face diameter or width 80, i.e. the ratio of the taper length 68 to the pad face diameter or width 80. In some embodiments, the taper length may range from limits of 10%, 20%, 30%, 40%, 50%, 60%, 70%, 80%, 90%, and 100% of the pad face diameter or width 80, where any limit may be used in combination with any other limit. For example, the taper length may range from 30-70%, or in some embodiments, may be 50%.

As illustrated in FIG. 8, the taper height 72 is associated with the overgauge travel 75. For example, in the taper angle example in FIG. 8 the overgauge travel length 75 and the taper height 72 are about equal.

Figure 9:
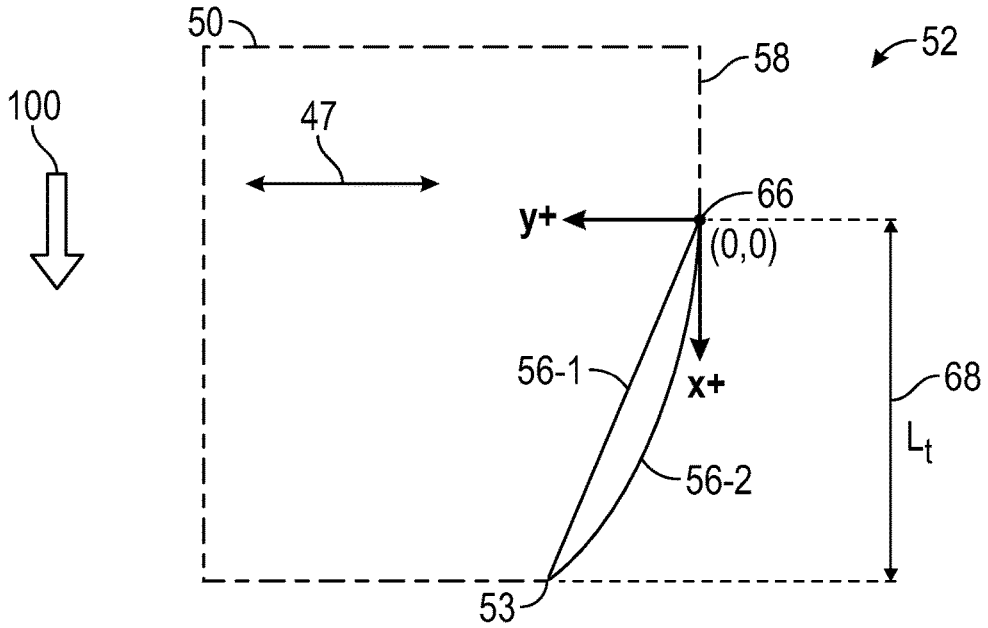
FIG. 9 illustrates shapes of a tapered section in accordance to aspects of the disclosure.

The tapered section 56 may be a curved surface as opposed to a flat or planar surface for example as illustrated in FIG. 9. A pad front face 52 is illustrated composed of a cylindrical shaped section 58 and a tapered section generally identified with the reference number 56. Reference to section 56 includes reference to sections 56-1 and 56-2. Tapered section 56-1 is formed by a substantially planar surface extending from the leading edge 53 to the take-off point 66. Tapered section 56-2 is formed with a curved or rounded surface. In accordance to aspects of this disclosure the tapered section may be defined by any shape that could be expressed on the form $$f(x)=\Sigma_{i=0}^{n} a_i x^i \tag{2}$$

Where f(x)>0 in the domain $$(X \in R \mid x \leq L_t) \tag{3}$$

The taper may be defined in other manners, e.g. polar coordinates, such as described below in particular with reference to circumferential tapers. The shape of the taper, circumferential and/or axial, can be described in terms of a circle-segment or any polynomial, including a line. The circle-segment, i.e., taper section 56-2 in FIG. 9, may be defined relative to the radius with a start point at the take-off position, tangent line, to an end point shown as the leading edge 53. To achieve the taper, the tapered portion has a radius of curvature that is less than the radius of curvature of the un-tapered portion. In other words, the tapered portion has more curvature than the curvature of the un-tapered portion.

Figure 10A:
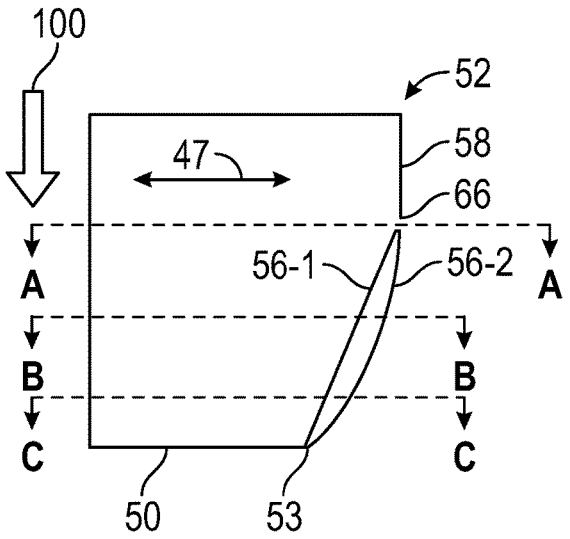
FIGS. 10A-10D illustrate an example of forming an axial tapered section on a steering pad face in accordance to aspects of the disclosure.

FIGS. 10A-10D illustrate another example of forming a shaped pad face 52 with an axial tapered section 56 in accordance to one or more aspects of the disclosure. FIG. 10A is a side view of a steering pad 50 having a shaped front face 52 with a non-tapered, cylindrical section 58 and a tapered section along the axial leading section of the face. The tapered section illustrates a flat surface tapered section 56-1 and a curved surface tapered section 56-2 as described with reference to FIG. 9. FIG. 10A also identifies levels A-A, B-B and C-C which are illustrated respectively in the top views of FIGS. 10B, 10C and 10D.

Figure 10B:
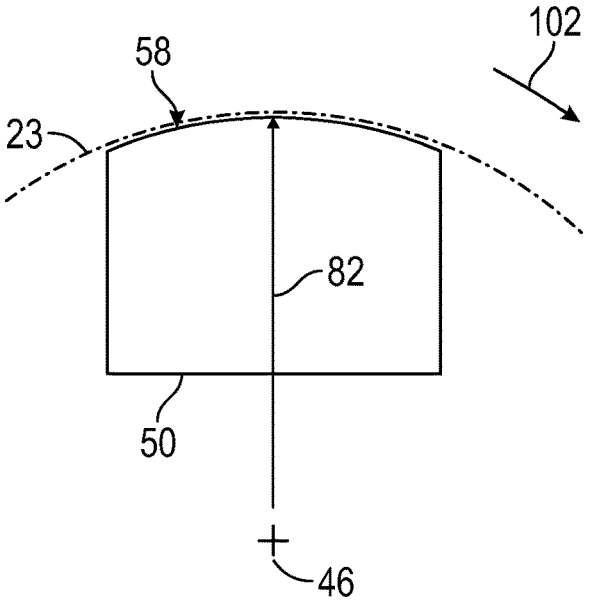
Figure 10C:
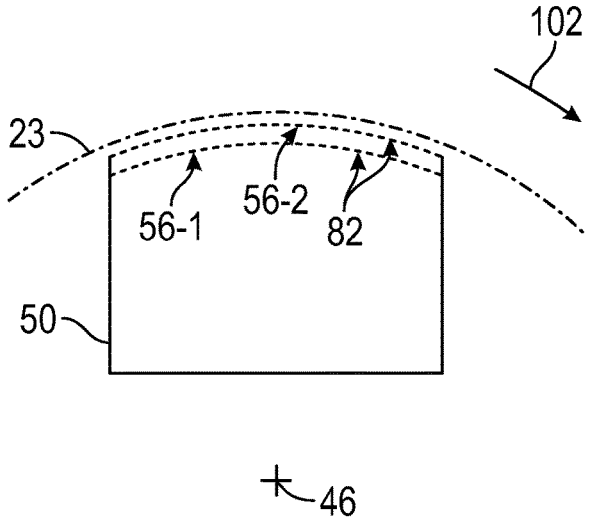
Figure 10D:
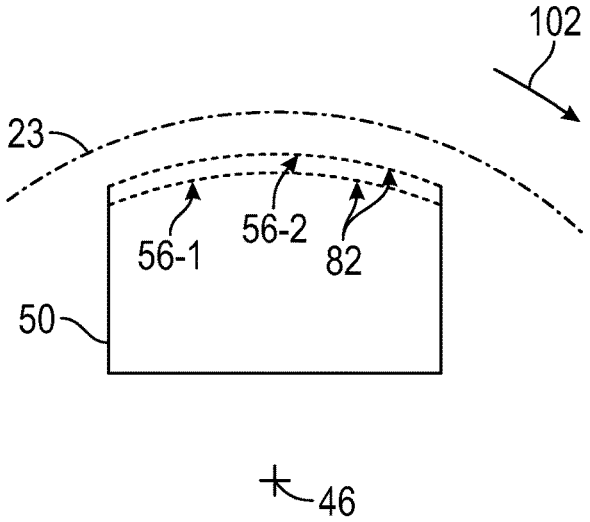

With reference in particular to FIGS. 10B-10C, the shaped pad face 52 has a cylindrical shaped surface in the circumferential direction with a radius 82 from the centerline 46 of the tool. As discussed above with reference to FIG. 7A, the radius 82 is equal to or substantially equal to the wellbore or gauge radius 62 along the non-tapered cylindrical section 58 such that the front face follows the contour of the drilled wellbore wall 23 as illustrated in FIG. 10B. The shape of pad face 52 may be formed (defined) for example by shifting the pad face 52 inward toward the centerline 46. In other words, the tapered section 56 maintains the circumferential radius 82 while the surface is tapered inward toward the centerline 46 and away from the wellbore wall 23 as it moves toward the axial leading edge 53 (FIG. 10A). Accordingly, the pad face 52 is cylindrically shaped in the circumferential direction and tapered inward extending in the axial direction.

Figure 11:
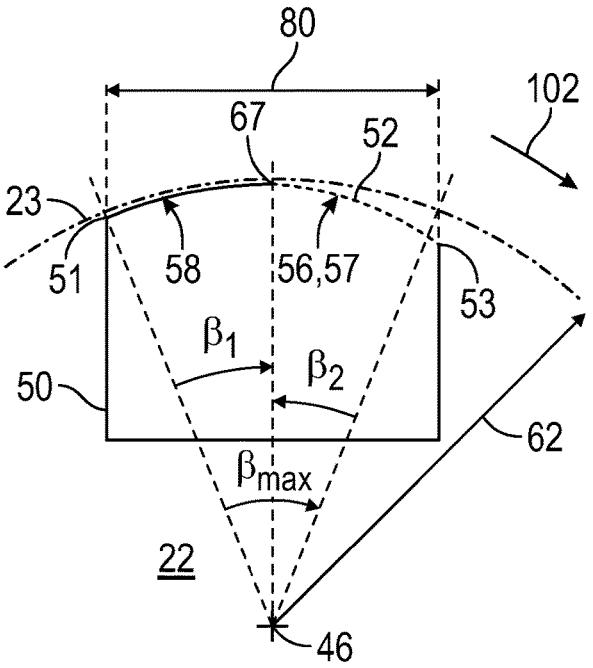
FIG. 11 is a top view in the drilling direction illustrating a steering pad front face having a circumferential tapered section in accordance to aspects of the disclosure.

As discussed above the face of the pad may also be tapered in the circumferential direction extending from the rotational leading edge. FIG. 11 is a top view illustrating a steering pad 50 having a shaped front face 52 with a circumferential tapered section identified generally with reference number 56 and specifically with reference number 57. The circumferential tapered section 57 extends from the rotational leading edge 53 relative to the direction of rotation 102 of the tool (e.g., BHA) a distance less than or equal to the full circumferential length of the pad face. The full circumferential length of the pad face may be described by the angle $\beta_{max}$ in FIG. 11 at the centerline 46 between from the rotational leading edge 53 and the opposite tail edge 51. The angle β1 illustrates the length of the non-tapered cylindrical section 58 from the trailing edge to a circumferential take-off point 67, or line, on the shaped face 52 and the angle β2 from the leading edge 53 to the take-off point 67 defines the circumferential tapered section. In accordance to one or more aspects the pad face 52 includes a circumferential tapered section 57 extending at an angle less than $\beta_{max}$. In a circumferential tapered section the leading edge of the face is moved inward, toward the tool and away from the wellbore wall, relative to the position of a the leading edge if the face was shaped with a radius similar to that of the gauge.

Figure 12A:
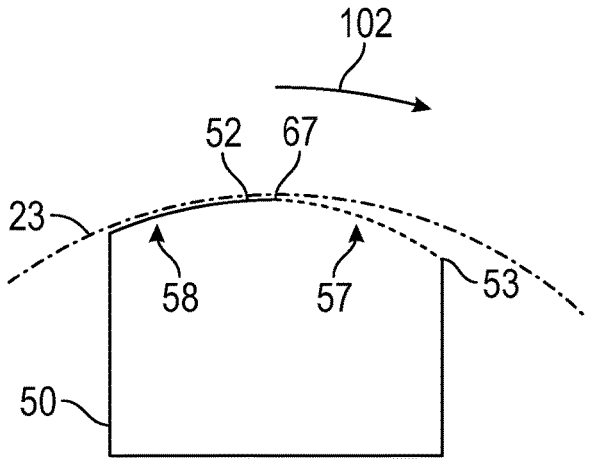
FIGS. 12A-12D are top views in the drilling direction of steering pads having different shaped circumferential tapered sections in accordance to aspects of the disclosure.
Figure 12B:
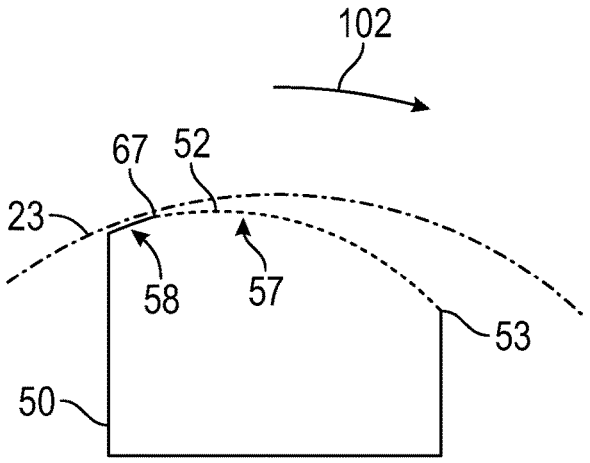
Figure 12C:
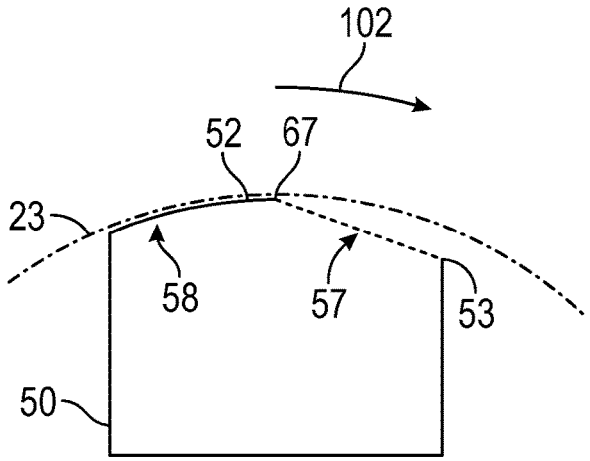
Figure 12D:
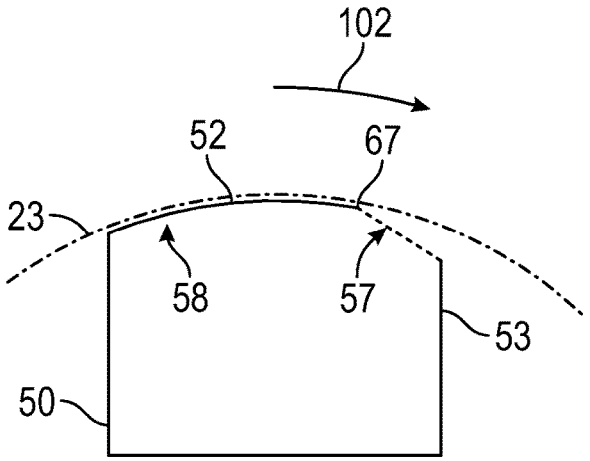

FIGS. 12A-12D are top views in the drilling direction of steering pads 50 illustrating different size and shapes of circumferential tapered sections 57. With additional reference to FIG. 11, the circumferential tapered sections 57 extend from the rotational leading edge 53 to the circumferential take-off position 67. In FIGS. 12A and 12B the shaped front face 52 of the circumferential tapered section 57 is curved and in FIGS. 12C and 12D the shaped front face 52 of the circumferential tapered section 57 is substantially planar. The shape of the circumferential tapered section 57 may be any shape that can be approximated by a polynomial on the form of equation (2) above. The circumferential taper may be straight or curved, and may include combinations of straight tapers, combinations of curved tapers, and combinations of straight and curved tapers. The circumferential taper β2 may range from limits of 5%, 10%, 15%, 20%, 30%, 40%, 50%, 65%, 80%, and 95% of $\beta_{max}$, where any limit can be used in combination with any other limit. For example, β2 may be between 10% and 50% of $\beta_{max}$.

Where the taper is planar or includes a plurality of planar segments, the taper may be defined as the angle relative to the tangent at the take-off position 67. That angle may be as described above with the downhole or axial taper, i.e., the circumferential planar taper may range between limits of about >0°, 1°, 3°, 6°, 10°, 15°, 20°, 30°, and 45°, where any limit can be used in combination with any other limit. For example, in some embodiments, the taper angles may range between 1° and 30°. In some embodiments, the downhole or axial taper may be 6°. However, any suitable taper angle may be used. In addition, multiple circumferential tapers may be used on each pad, and each pad may have different circumferential tapers.

The straight and/or curved circumferential tapers may also be described in reference to Formula 1, above. In some embodiments, the circumferential taper may range between limits of about 25%, 50%, 75%, 100%, 150%, 200%, 300%, and 400% of $\alpha_{opt}$ where any limit may be used in combination with any other limit. For example, the taper angle may range from 25% to 200% of $\alpha_{opt}$. When Formula 1 is used to define the curved taper, a straight line may be drawn from the start of the taper to the take-off point to define the taper angle $\alpha_{opt}$.

The shape of the axial and circumferential tapered sections can be described in polar coordinate representations for a circle by the equation (4) below with reference to FIGS. 13 and 14.

$$r(\theta) = 2r_0\cos\left(\theta\ \frac{\pi}{2}\right) \tag{4}$$

Where:

$$r_w \geq r_0 \geq \frac{d_p}{2} \tag{5}$$

and $d_p$ is the pad face diameter or width 80 (FIG. 11).

Figure 13:
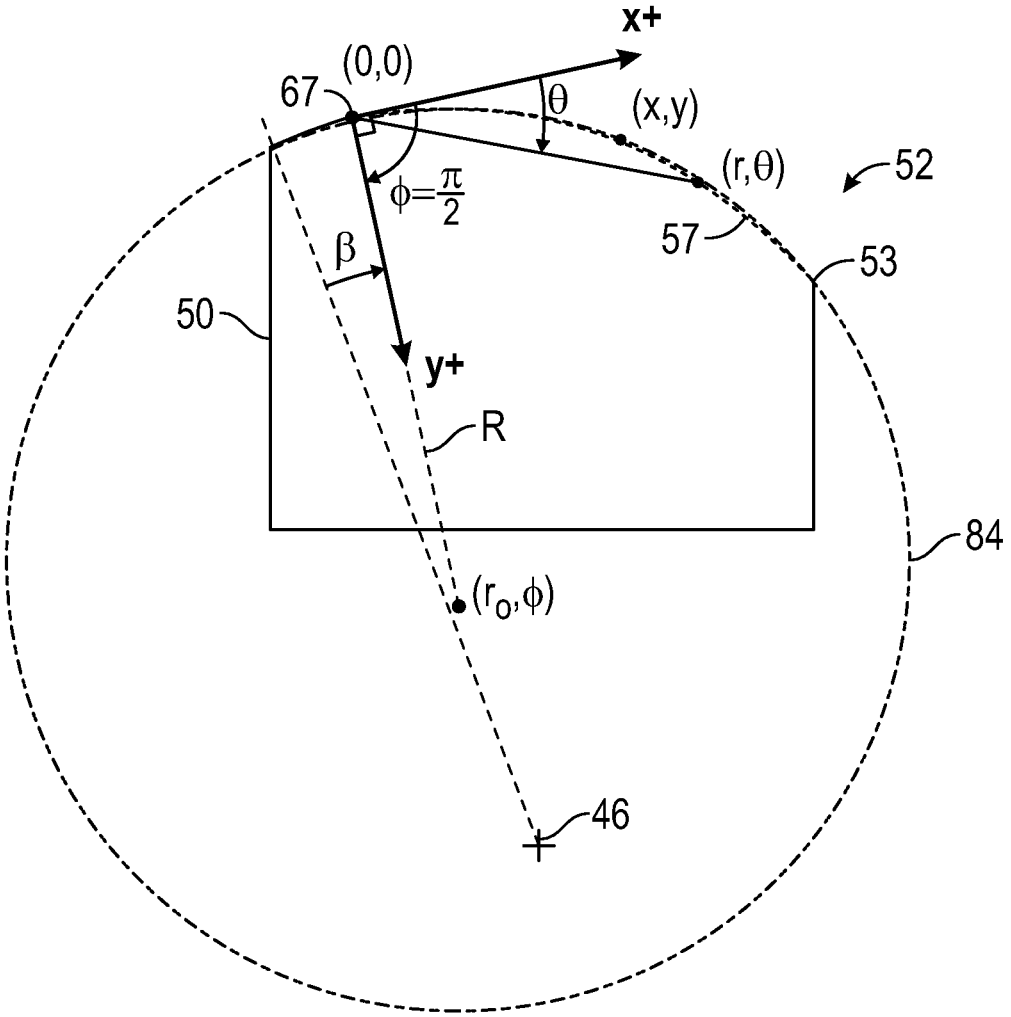
FIG. 13 illustrates a steering pad having a shaped face with a circumferential tapered section corresponding with a curvature of a circle in accordance to aspects of the disclosure.
Figure 14:
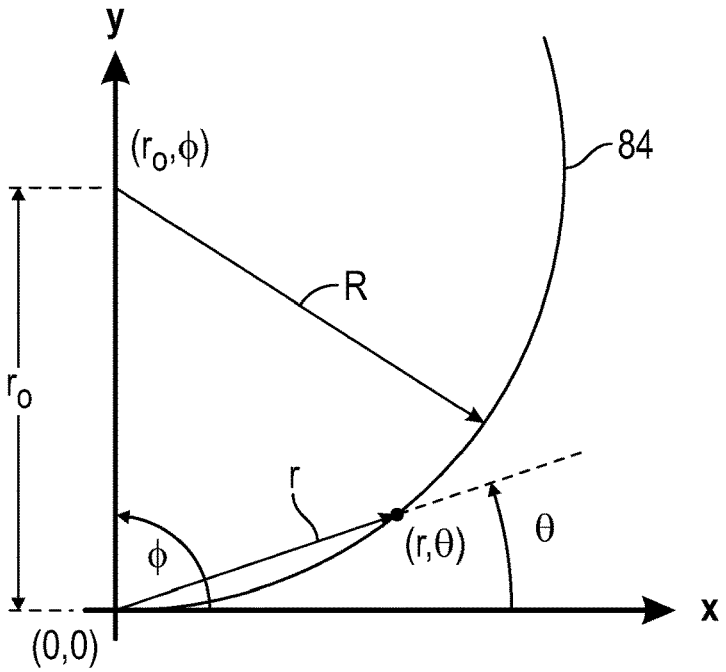
FIG. 14 illustrates the aspects of FIG. 13 in polar coordinates.

FIG. 13 illustrates a pad 50 having a shaped face 52 with a circumferential tapered section corresponding with a curvature of a circle 84. FIG. 14 illustrates the circle 84 in polar coordinates, where R is the radius of circle 84, (r,θ) is the polar coordinate of a point on the circle and (r0,) is the center of the circle 84. The general form of the equation for a circle in polar coordinates may be written as:

$$r^2 2rr_0\cos(\theta)+r_0^2=R^2 \tag{6}$$

In the special case of FIG. 14 the equation is simplified to the expression below as $r_0$=R.

$$r^2 2rr_0\cos\left(\theta\ \frac{\pi}{2}\right) = 0 \tag{7}$$

Figure 15:
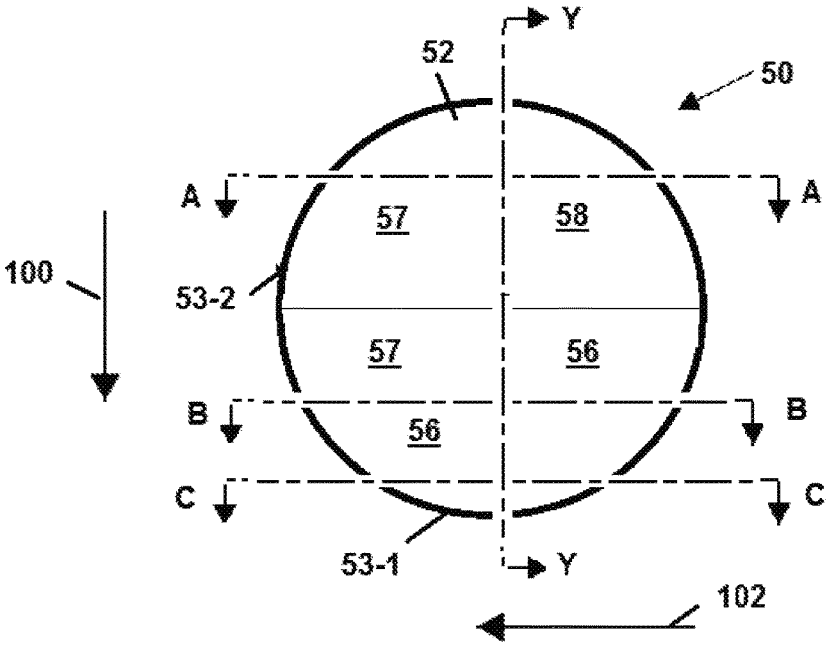
FIG. 15 illustrates an example of a steering pad front face having axial and circumferential tapered sections in accordance to aspects of the disclosure.

The shaped face of the pad may include an axial tapered section and a circumferential tapered section. FIG. 15 illustrates an example of a shaped pad face 52 having multiple tapered sections. The leading edges 53 are identified in FIG. 15 as the axial leading edge 53-1 relative to the downhole drilling direction 100 and the rotational leading edge 53-2 relative to the rotation direction 102. In this example the bottom axial leading section of the shaped face 52 is defined with an axial taper 56 and the circumferential leading section, on the left side, has a circumferential taper 57. The upper right hand section is a non-tapered, cylindrical section 58.

Figure 16:
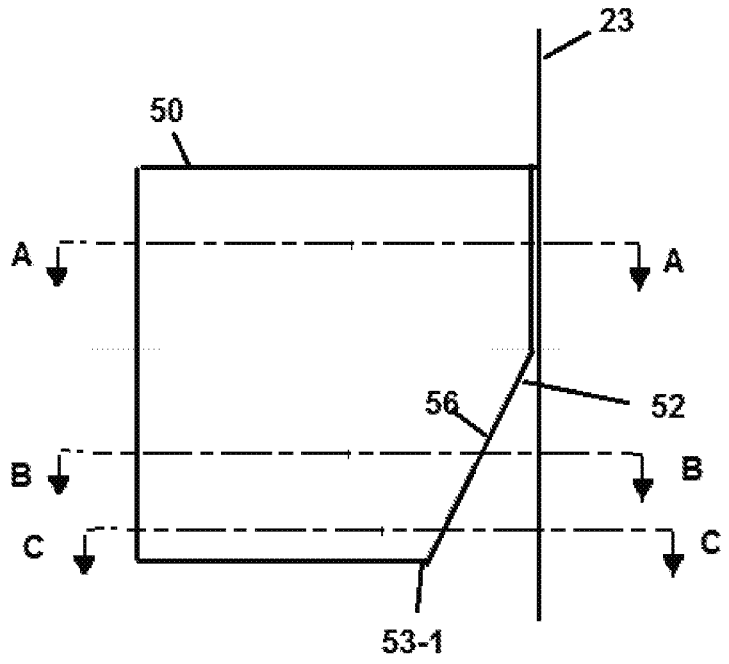
FIG. 16 is a side view of a steering pad in accordance to aspects of the disclosure along the line Y-Y of FIG. 15.
Figure 17:
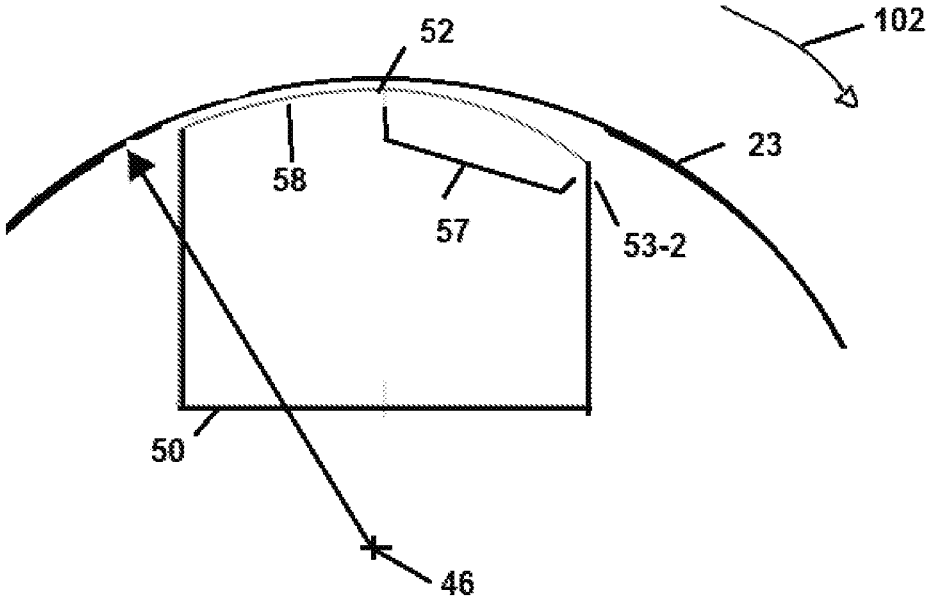
FIG. 17 is a top view of a steering pad in accordance to aspects of the disclosure along the line A-A of FIG. 15.
Figure 18:
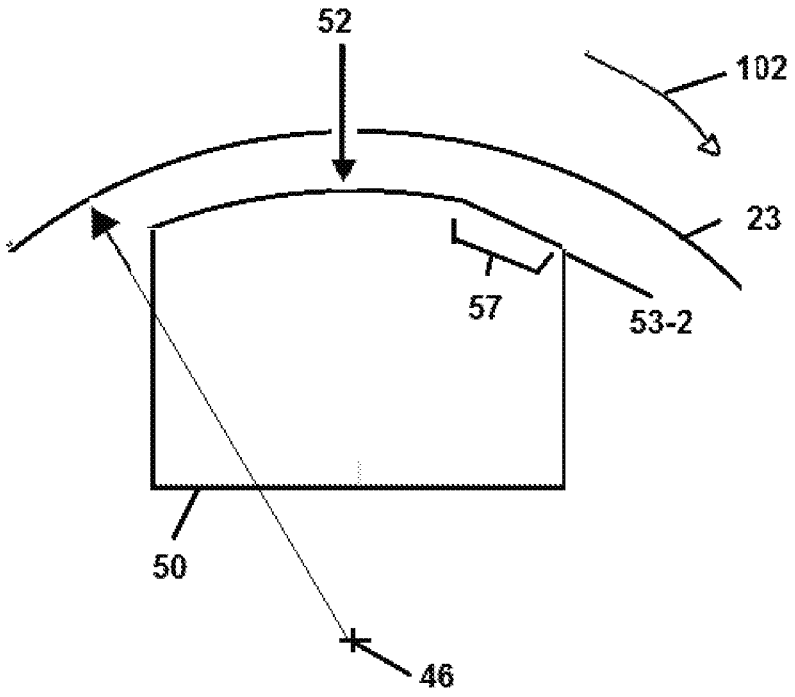
FIG. 18 is a top view of a steering pad in accordance to aspects of the disclosure along the line B-B of FIG. 15.
Figure 19:
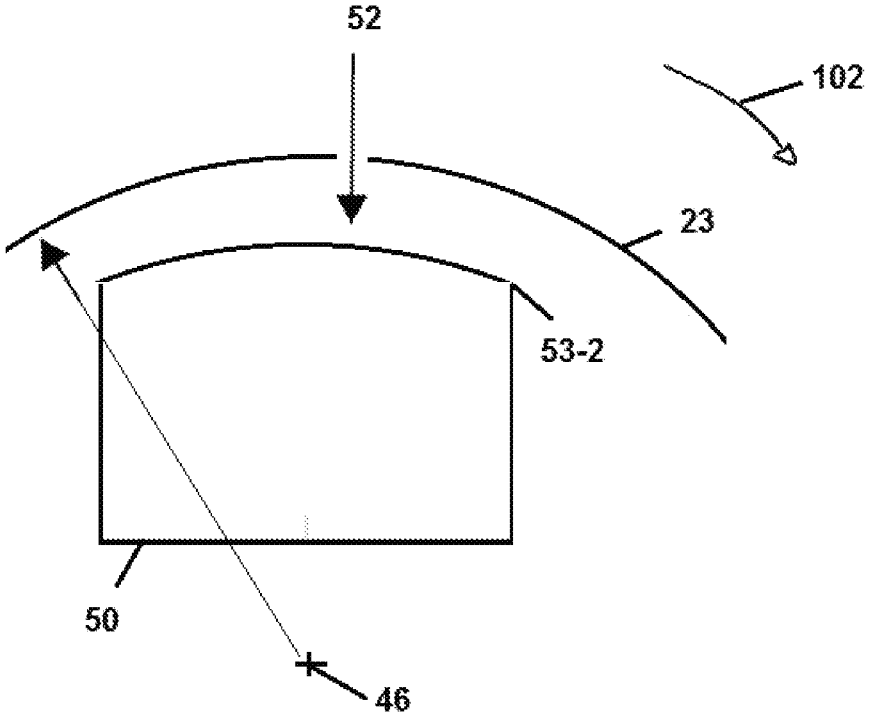
FIG. 19 is a top view of a steering pad in accordance to aspects of the disclosure along the line C-C of FIG. 15.

FIG. 16 is a side view of the pad 50 of FIG. 15 along the line Y-Y. FIGS. 17, 18 and 19 are views of the pad 50 of FIG. 15 respectively along the lines A-A, B-B, and C-C.

The straight and/or curved tapers (both axial and circumferential) could also be described with reference to the point on the pad closest to the centerline of the tool (the edge of the pad that starts the taper) and the take-off position. The pads may be configured such that when the pad is fully extended, the point on the pad closest to the centerline of the tool is at the gage of the drill bit. The position of the take-off point may be selected as described above. The curved taper or planar taper may then be defined as a straight or curved line from that point to the take-off position. As described above, multiple straight and/or curved and/or combinations of straight and curved taper sections may be used.

Figure 20:
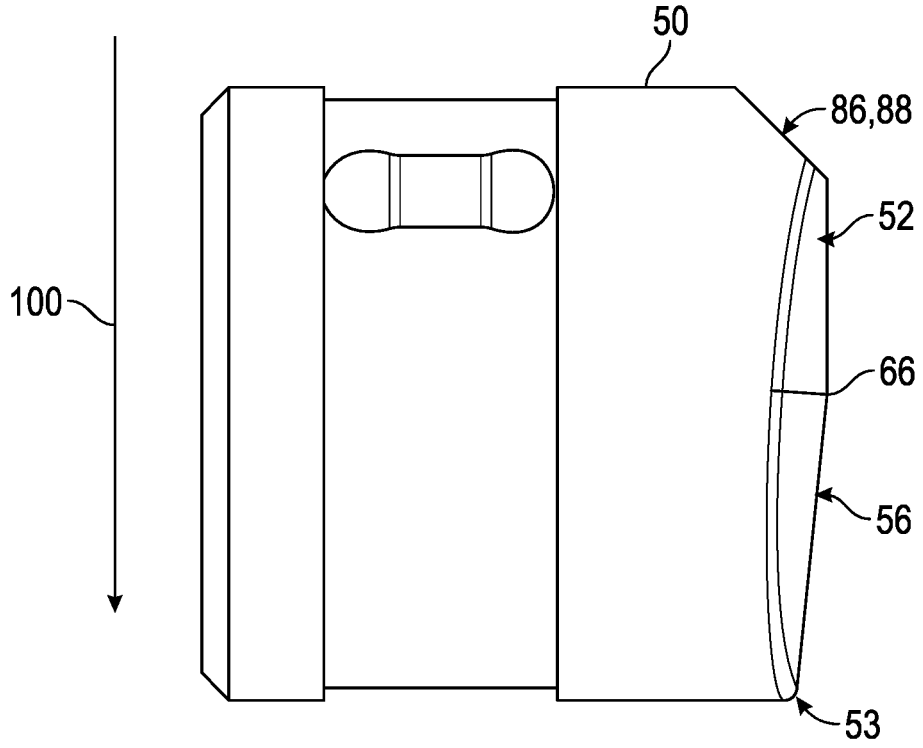
FIG. 20 is a side view of a steering piston and pad in accordance to aspects of the disclosure.

FIG. 20 is a side view illustrating an example of a steering pad 50. The face 52 includes an axial tapered section 56 extending from a take-off point 66 to about the axial leading edge 53. In this example, the trailing edge 86 (uphole edge) of the face 52 in the in the axial direction includes a trailing taper 88. The trailing taper 88 may be included for example as a safety feature to reduce the risk of the hanging in the wellbore when pulling out of the hole. The uphole taper 88 may assist in pushing the piston into the tool and thereby enable the tool to pass a restriction (e.g., casing, ledge). The extent of this trailing taper can vary and may be associated with the travel length of the piston/pad. For example, for an overgauge travel of about 10 mm the trailing taper may extend about 10 mm or greater radially inward toward the centerline of the tool. In accordance to non-limiting aspects the anger of the trailing taper may range for example between limits of greater than 0°, 1°, 3°, 6°, 10°, 15°, 20°, 30°, 45°, 50°, 60° and 70°. For example, in some embodiments, the range may extend between 20° and 60°. In some embodiments, the taper angle is about 45 degrees. If the angle of the taper is too steep the risk of hanging increases and if the trailing edge angle is too shallow too much of the front face 52 may be lost.

Figure 21:
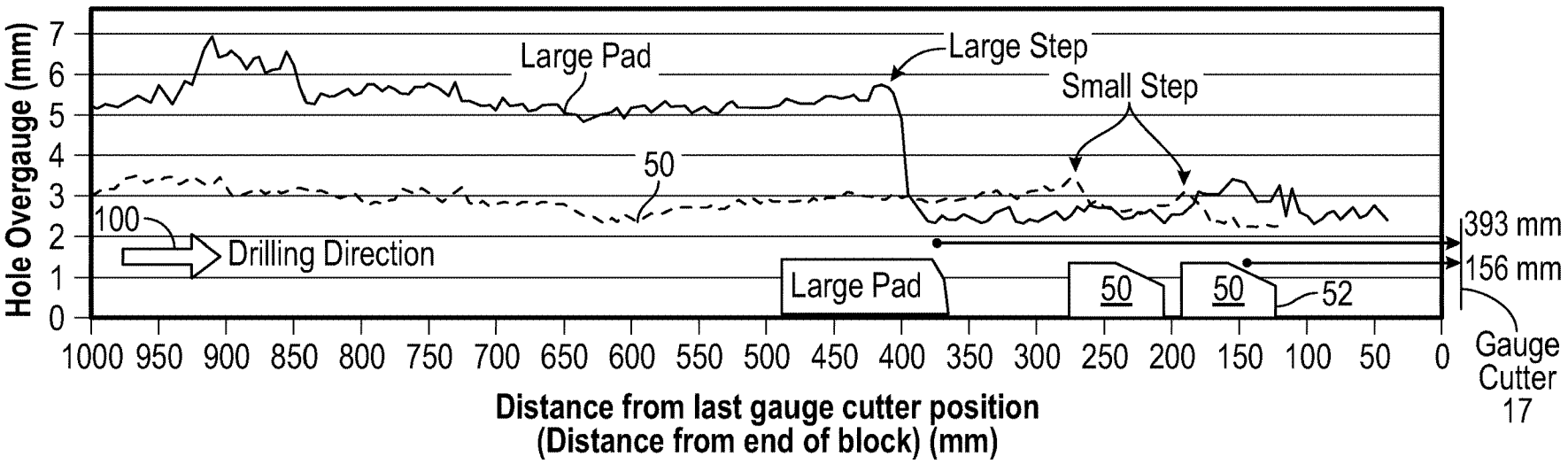
FIG. 21 graphically illustrates underreaming effects of shaped face steering pads in accordance to aspects of the disclosure versus a large pad, non-shaped front face steering pad.

FIG. 21 is graph showing the difference in underreaming between a steering tool 32 (see, e.g., FIG. 3) utilizing a pair 150 of shaped face 52 steering pads 50, axially aligned in close proximity, in accordance to an embodiment of this disclosure versus a large flat faced steering pad. The bit size in the two tests were 8½ inch for the large pad and 8¾ inch for the shaped face pads 50, the bit nozzles were the same and the flow rate was similar (+/−330 GPM) resulting in the same pressure drop across the bits. The steering force for each of the two concurrently actuating shaped face pads 50 was approximately 11-12 kN (total 22-24 kN). The steering force generated by the large pad was approximately 10 kN. The shaped face pads 50 were located 156 and 246 mm from the first gauge cutter 17 to the pad center. The large pad starts at 393 mm away from the first gauge cutter. The dogleg severity (DLS) in the large pad test was 5.9 degrees/100 ft. and the DLS in the shaped front face pad tool 32 was approximately 10 degrees/100 ft.

The wellbore is slightly overgauge relative to the bit size as shown at the far right side of the graph. Following the line showing the overgauge of the size of the wellbore for the large pad test a significant increase (large step) in the overgauge occurs as the large pad passes through the wellbore. In contrast there is a small increase in the overgauge size of the wellbore as the each of the shaped face pads is moved downhole. These test results indicate that the shape of the front face pad has a greater effect on reducing the underreaming effect of the steering pads than the size of the front face.

Figure 22:
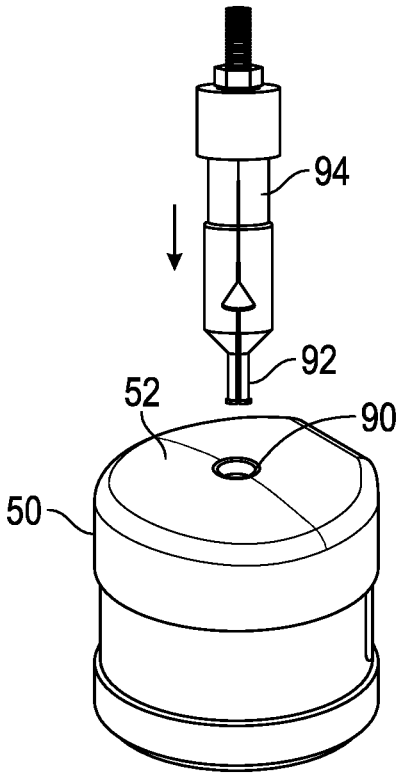
FIGS. 22 and 23 illustrate a steering pad in accordance to aspects of the disclosure with an extraction device.
Figure 23:
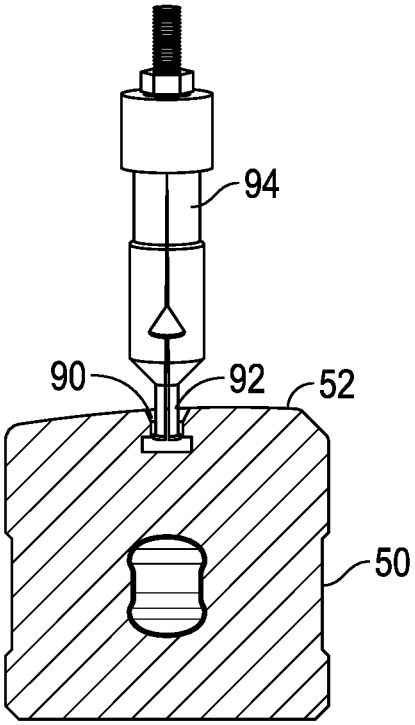

FIGS. 22 and 23 illustrate features for extraction or pulling a piston 50. Piston 50 includes a hole 90 formed in the front face 52, for example proximate to the center point. The hole 90 has a diameter or width that increases as the hole extends further into the pad. A first end 92 of an extraction tool 94 can be inserted into the extraction hole 90 as illustrated for example in FIG. 23. The extraction tool 94 is then actuated to expand the first end to extend to the larger width further into the hole to secure the tool 94 to the piston 50. The tool may then be pulled to remove the piston 50 for example from a steering tool.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Additionally, it should be understood that references to "one embodiment" or "an embodiment" of the present disclosure are not intended to be interpreted as excluding the existence of additional embodiments that also incorporate the recited features. For example, features shown in individual embodiments referred to above may be used together in combinations other than those which have been shown and described specifically. Accordingly, any such modification is intended to be included within the scope of this disclosure. In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function for any limitations of any of the claims herein, except for those in which the claim expressly uses the words 'means for' together with an associated function.

What is claimed is:

1. A rotary steerable device, comprising a steering pad disposed with a drilling tool and radially moveable relative to a centerline of the drilling tool to apply a steering force to a borehole wall, the steering pad having a front face to contact the borehole wall, wherein the front face has a diameter or width and a tapered section that tapers inward at a taper angle toward the centerline along a taper length in the direction from a take-off position to a leading edge relative to a drilling direction, wherein the take-off position extends across the front face transverse to the drilling direction, and wherein the tapered section tapers in an axial direction.

2. The device of claim 1, wherein the tapered section creates a rock removal contact surface resulting in a contact pressure against the borehole wall that is less than the compressive strength of an earthen formation forming the borehole wall prior to the pad reaching its maximum radial travel length.

3. The device of claim 1, wherein the taper length is substantially equal to the diameter or width of the front face.

4. The device of claim 1, wherein the taper length is in the range between about 10 percent and about 100 percent of the diameter or width of the front face.

5. The device of claim 1, wherein the taper angle is between about one degree and about twenty degrees.

6. The device of claim 1, wherein the taper length is in the range between about 10 percent and about 100 percent of the diameter or width of the front face; and the taper angle is between about one degree and about twenty degrees.

7. The device of claim 1, wherein the tapered section has a taper height which is the distance between the leading edge and the take-off point, wherein the taper height is equal to or about equal to an overgauge radial travel length of the pad.

8. The device of claim 1, wherein the taper length is substantially planar.

9. The device of claim 1, wherein the taper length is curved.

10. The device of claim 1, wherein the leading edge of the tapered section is an axial leading edge relative to the drilling direction and the front face further comprises a circumferential tapered section extending from a circumferential take-off point on the front face to the rotational leading edge relative to the direction of rotation of the drilling tool.

11. The device of claim 10, wherein the front face extending from the circumferential take-off position to a trailing edge opposite the rotational leading edge is cylindrically shaped.

12. The device of claim 10, wherein at least the taper length extending in the drilling direction is substantially equal to the diameter or width of the front face.

13. The device of claim 10, wherein the taper length extending in the drilling direction is in the range between about 10 percent and about 100 percent of the diameter or width of the front face.

14. The device of claim 10, wherein the taper angle of the taper length extending in the drilling direction is between about one degree and about twenty degrees.

15. The device of claim 10, wherein the taper length extending in the drilling direction is in the range between about 10 percent and about 100 percent of the diameter or width of the front face; and the taper angle is between about one degree and about twenty degrees.

16. The device of claim 10, wherein the tapered section extending in the drilling direction has a taper height which is the distance between the leading edge and the take-off point, wherein the taper height is equal to or about equal to an overgauge radial travel length of the pad.

17. A method, comprising preparing a steering pad for a drilling tool having a center line oriented along a drilling direction, the steering pad having an actuation axis oriented perpendicular to the centerline, and a front face having an axial leading edge in the drilling direction, wherein the front face has an axial tapered section that tapers inward at a taper angle toward the centerline along a taper length in the direction from a first take-off position to the axial leading edge, wherein the taper angle is between about one degree and about twenty degrees.

18. The method of claim 17, further comprising forming a circumferential tapered section extending from a second take-off position on the front face inward toward the centerline to the rotational leading edge.

19. A bottom hole assembly (BHA), comprising:

a drill bit having a gauge and a centerline extending in a drilling direction; and a tool connected with the drill bit, the tool comprising an upper steering pad and a lower steering pad axially aligned in the drilling direction, wherein the steering pads are radially moveable along a travel length from a fully retracted position to a fully extended position, the steering pads each comprise:

a front face for contacting a borehole wall to apply a steering force, wherein the front face has an axial leading edge in the drilling direction, wherein the front face has an axial tapered section that tapers inward at a taper angle toward the centerline along a taper length in the direction from a first take-off position to the axial leading edge, wherein the taper length is in the range between about 10 percent and about 100 percent of a diameter or width of the front face.

20. The BHA of claim 19, wherein the front face further comprises a circumferential tapered section extending from a second take-off position on the front face inward toward the centerline to the rotational leading edge.

* * * * *